US007284808B2

(12) United States Patent
Kasamatsu

(10) Patent No.: US 7,284,808 B2
(45) Date of Patent: Oct. 23, 2007

(54) IMAGE RECORD APPARATUS

(75) Inventor: Daisuke Kasamatsu, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 215 days.

(21) Appl. No.: 11/071,319

(22) Filed: Mar. 4, 2005

(65) Prior Publication Data

US 2005/0195231 A1 Sep. 8, 2005

(30) Foreign Application Priority Data

Mar. 5, 2004 (JP) ..... 2004-061811

(51) Int. Cl.
*B41J 2/195* (2006.01)

(52) U.S. Cl. ..... 347/7; 347/19

(58) Field of Classification Search ..... 347/7, 347/19

See application file for complete search history.

(56) References Cited

U.S. PATENT DOCUMENTS 6,070,964 A * 6/2000 Sumiya ..... 347/43
2003/0112457 A1 6/2003 Akiyama et al.
2003/0224197 A1 12/2003 Soga et al.
2004/0041858 A1 3/2004 Im et al.

FOREIGN PATENT DOCUMENTS

| | | |
|---|---|---|
| EP | 0 707 969 | 4/1996 |
| JP | 11-069058 | 3/1999 |
| JP | 11065256 | 3/1999 |
| JP | 11069058 | 3/1999 |

OTHER PUBLICATIONS

CN Office Action dated Aug. 18, 2006 in Application No. 200510053090.1.
esp@cenet Family list of "JP2003260587". Search done on Nov. 11, 2004.
CN Office Action dtd Jun. 1, 2007, CN App. 200510053090.1.

* cited by examiner

*Primary Examiner*—Thinh Nguyen
(74) *Attorney, Agent, or Firm*—Banner & Witcoff, Ltd.

(57) ABSTRACT

If the remaining amount of a recording agent such as ink or toner becomes small in an image record apparatus, a message, etc., to the effect that the remaining amount is small is displayed on a display only for a predetermined time each time an image record command is entered, and then the display is restored to display indicating the current state of the image record apparatus.

11 Claims, 14 Drawing Sheets

1
90
93
RAM
93a
FLAG1 STORAGE AREA
93b
FLAG2 STORAGE AREA
93c
FLAG3 STORAGE AREA
93d
FLAG4 STORAGE AREA
92
ROM
96
G/A
IMAGE MEMORY
95
I/F
97
94
EEPROM
94a
FIRST UP COUNTER
94b
SECOND UP COUNTER
98
99
91
CPU
T
110
DRIVE CIRCUIT
25a
CR MOTOR DRIVE CIRCUIT
65c
A/D
65a
LIGHT EMISSION ELEMENT
65b
LIGHT RECEPTION ELEMENT
65
14
OPERATION PANEL
LCD
14a
CR
25

94a
94b
K
C
M
Y

T
T1
T2

IMAGE RECORD APPARATUS

BACKGROUND OF THE INVENTION

1. Field of the Invention

This invention relates to an image record apparatus for recording an image on a record medium such as paper using a recording agent such as toner or ink.

2. Description of the Related Art

An image record apparatus for displaying a near-empty state in which it will soon be made impossible to record although recording an image can continue on a liquid crystal display (LCD) on an operation panel by detecting the remaining amount of a recording agent such as toner or ink has been invented. For example, JP-A-11-69058 (see FIG. 4) discloses an ink-jet image record apparatus previously applied by the applicant of the present invention.

According to the image record apparatus, if the fact that the remaining amount of ink of some color is in a near-empty state is detected, an error message is displayed on an LCD and a buzzer is sounded. Accordingly, if the remaining amount of ink of some color enters a near-empty state, the user on the periphery of the image record apparatus can be notified that the ink remaining amount enters a near-empty state. Further, if an error transmission mode is set in the image record apparatus and a destination is also set, the description of the error is transmitted to the destination. Accordingly, a message to the effect that the remaining amount of ink of some color enters a near-empty state is also sent to the destination preset in the image record apparatus (telephone number of fixed telephone at the place where the user goes, at fixed called party, etc., mobile phone, radio pager, etc., e-mail address of mobile phone, personal computer, etc., or the like), so that the user can be notified more reliably that the ink remaining amount has become small.

SUMMARY OF THE INVENTION

However, in the image record apparatus described in JP-A-11-69058, once a near-empty state is detected, the near-empty alarm remains displayed on the LCD unless the ink cartridge is replaced to increase the ink remaining amount, and information concerning the current function of the current mode setting, etc., of the image record apparatus is not displayed on the LCD and thus the user is hard to keep track of the current function and it is inconvenient for the user; this is a problem.

It is an object of the invention to provide an image record apparatus for recording an image on a record medium such as paper using a recording agent such as toner or ink, the image record apparatus capable of reliably notifying the user of a near empty state of the recording agent and also notifying the user of information concerning the current function of the current mode setting, etc.

According to one aspect of the invention, there is provided with an image record apparatus capable of recording an image on a record medium using a recording agent, including:

a detection member that detects a remaining amount of a recording agent;

a notification member capable of notifying a user of the detection result of the detection member; and a control member that controls the detection member and the notification member, wherein if the detection member detects that the remaining amount of the recording agent is equal to or less than a predetermined amount although image record on a record medium can be continued, the control member controls the notification member to notify the user that the remaining amount of the recording agent is equal to or less than the predetermined amount for a predetermined time, wherein the control member controls the notification member to stop the notification, and wherein the control member provides the user with information concerning a current function of the image record apparatus.

By thus configuration, if the detection member detects that the remaining amount of the recording agent is equal to or less than a predetermined amount although image record on a record medium can be continued, the control member causes the notification member to notify the user that the remaining amount of the recording agent is equal to or less than the predetermined amount, namely, a near empty state is entered for the predetermined time and then causes the notification member to stop the notification and provide the user with information concerning the current function of the image record apparatus, so that the user can recognize the near empty state and can also recognize the information concerning the current function of the current mode setting, etc., of the image record apparatus.

According to another aspect of the invention, at least when an image record command is executed for the image record apparatus, the control member controls the detection member to detect the remaining amount of the recording agent.

By thus configuration, the user is repeatedly notified of the near empty state each time record is executed, so that the user can recognize the near empty state more reliably.

According to another aspect of the invention, when power of the image record apparatus is turned on, the control member causes the detection member to detect the remaining amount or the recording agent.

By thus configuration, the user can also be notified of the near empty state in addition to the time of execution of an image record command, so that the user can recognize the near empty state more reliably.

According to another aspect of the invention, the image record apparatus further including:

a storage member that stores the detection result of the detection member; and an input member enabling the user to enter a command of causing the notification member to make a notification as to whether or not the remaining amount of the recording agent is equal to or less than the predetermined amount although image record on the record medium can be continued, wherein when the user enters the command through the input member, the control member causes the notification member to notify the user of the detection result stored in the storage member.

By thus configuration, the user can recognize the ink near empty state at any time as desired in addition to the time of powering on the image record apparatus and the time of entry of a record command.

According to another aspect of the invention, when the user enters the command through the input member, the control member does not allow the detection member to operate.

By thus configuration, the user can recognize the ink near empty state more rapidly.

DESCRIPTION OF THE PREFERRED EMBODIMENTS

Figure 1:
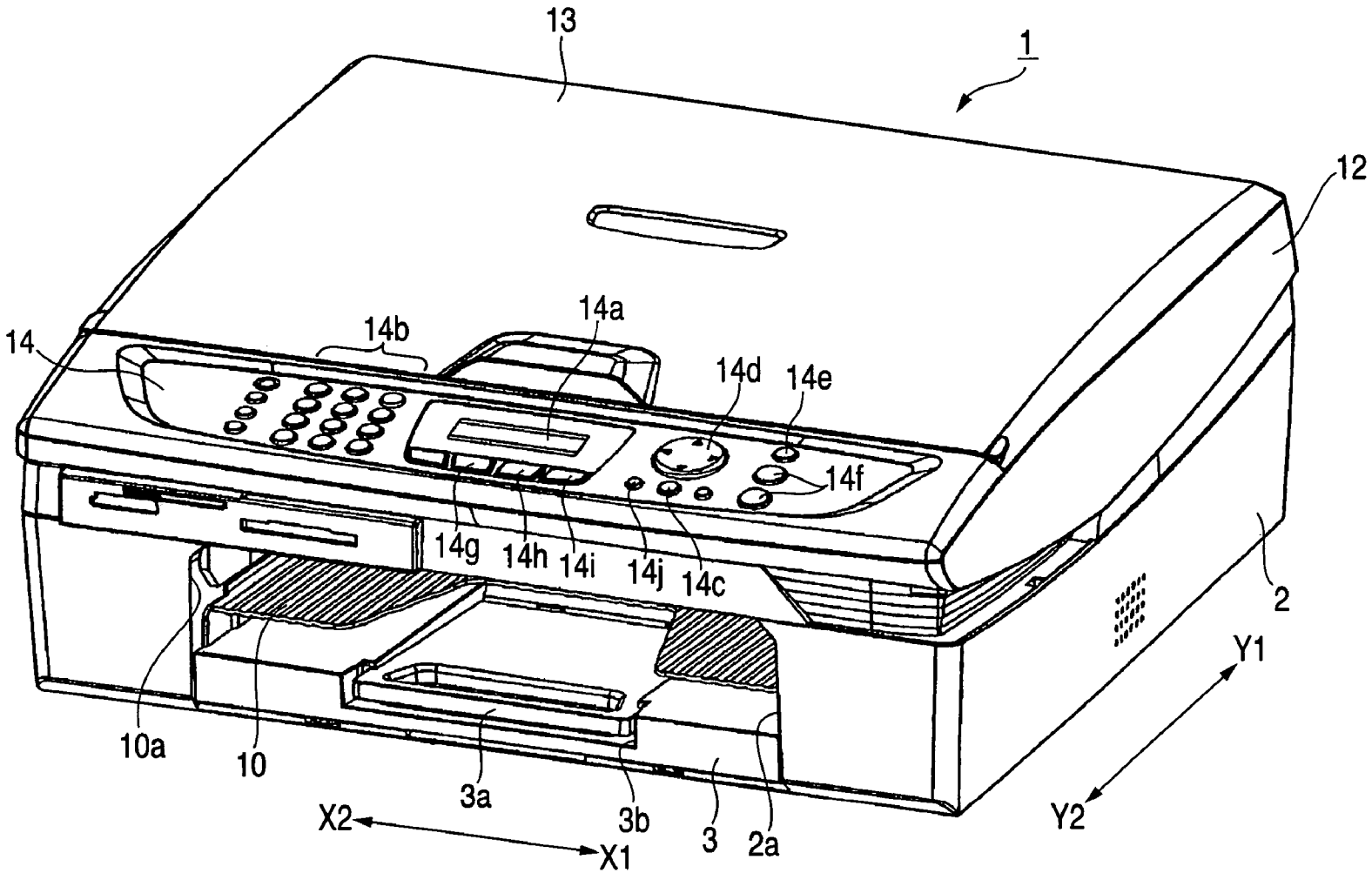
FIG. 1 is a perspective view of an image record apparatus according to an embodiment of the invention.
Figure 3:
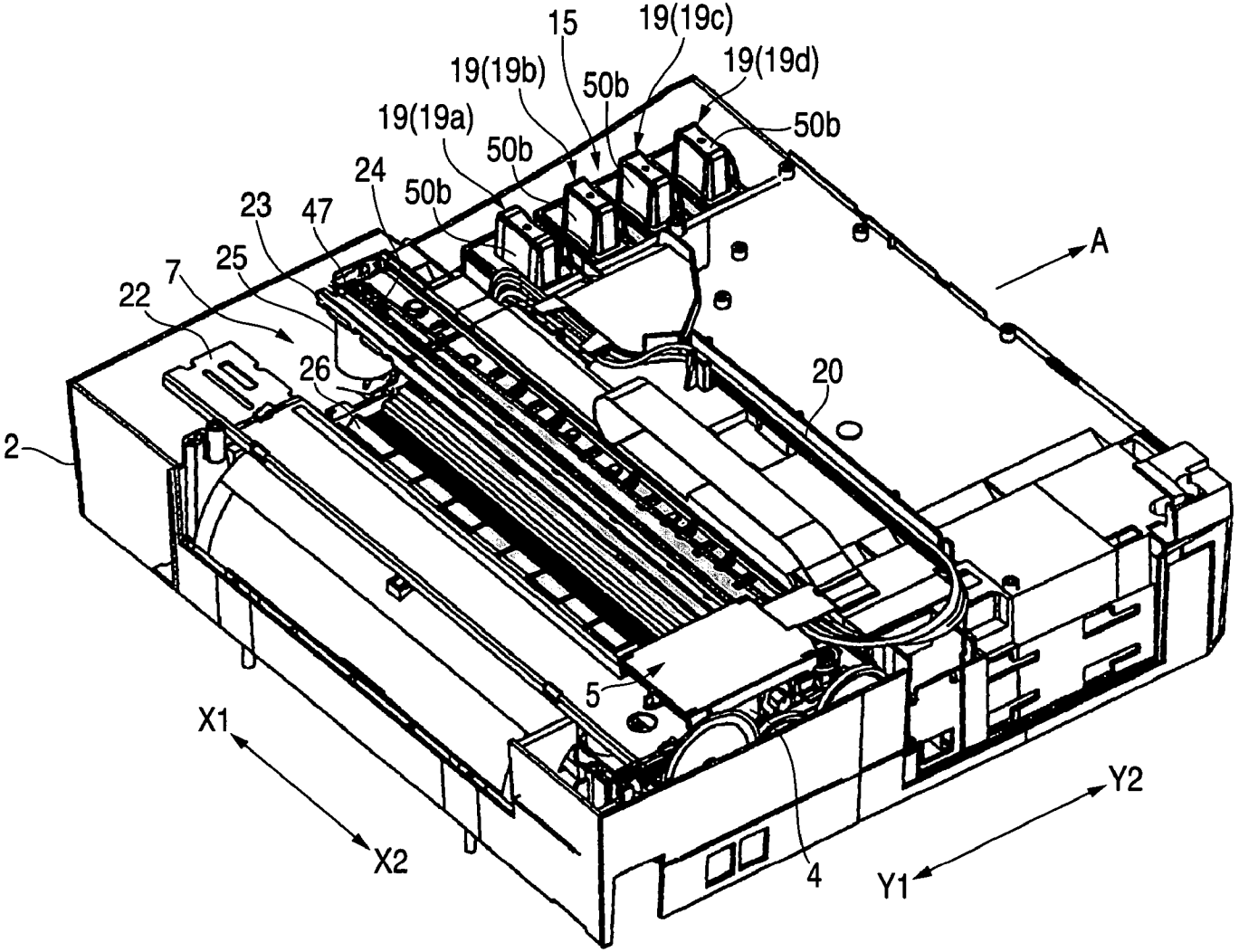
FIG. 3 is a perspective view of the image record apparatus from the rear with an image reader removed.
Figure 4:
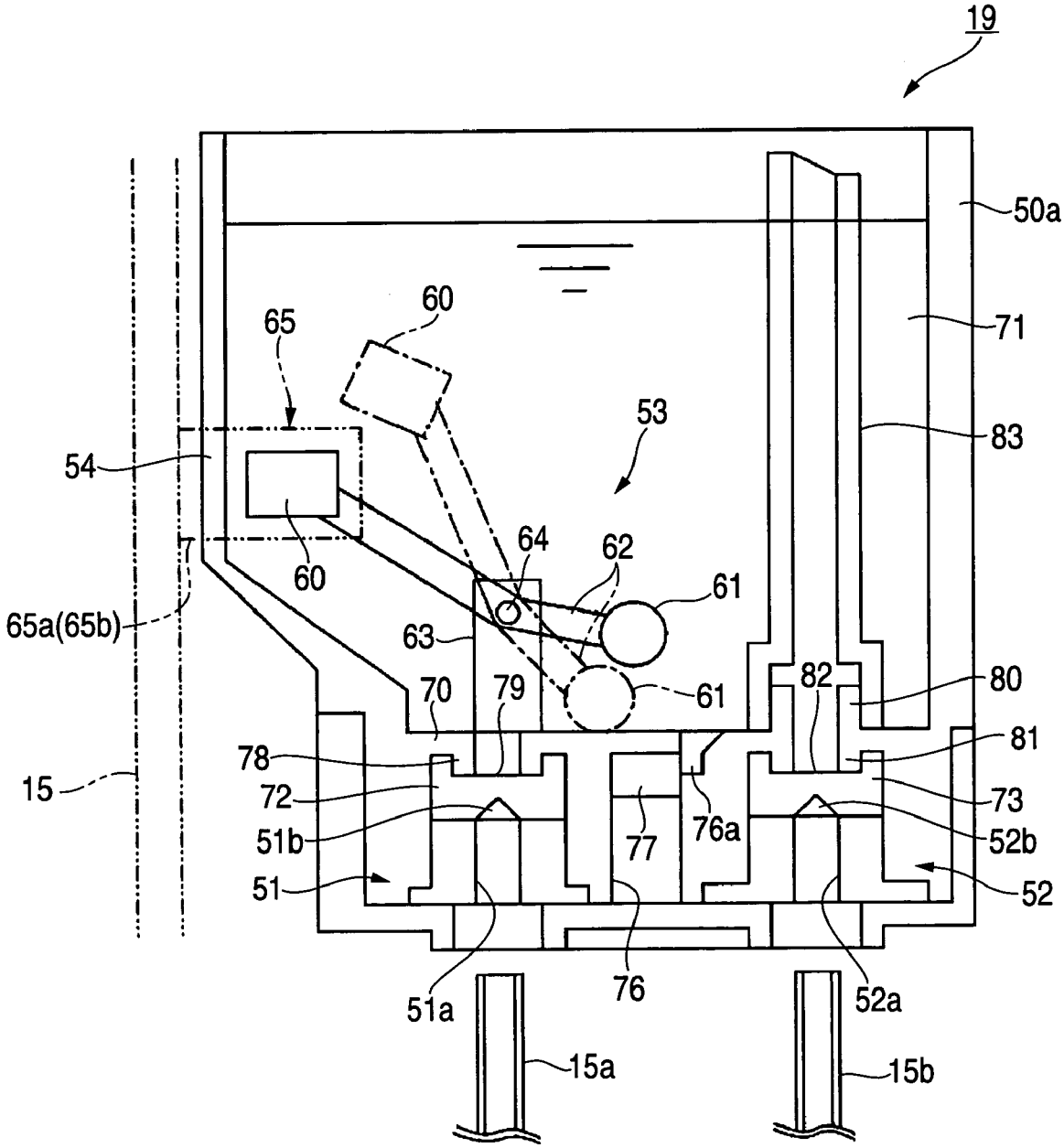
FIG. 4 is a schematic sectional view of an ink cartridge.
Figures 5A, 5B, 5C:
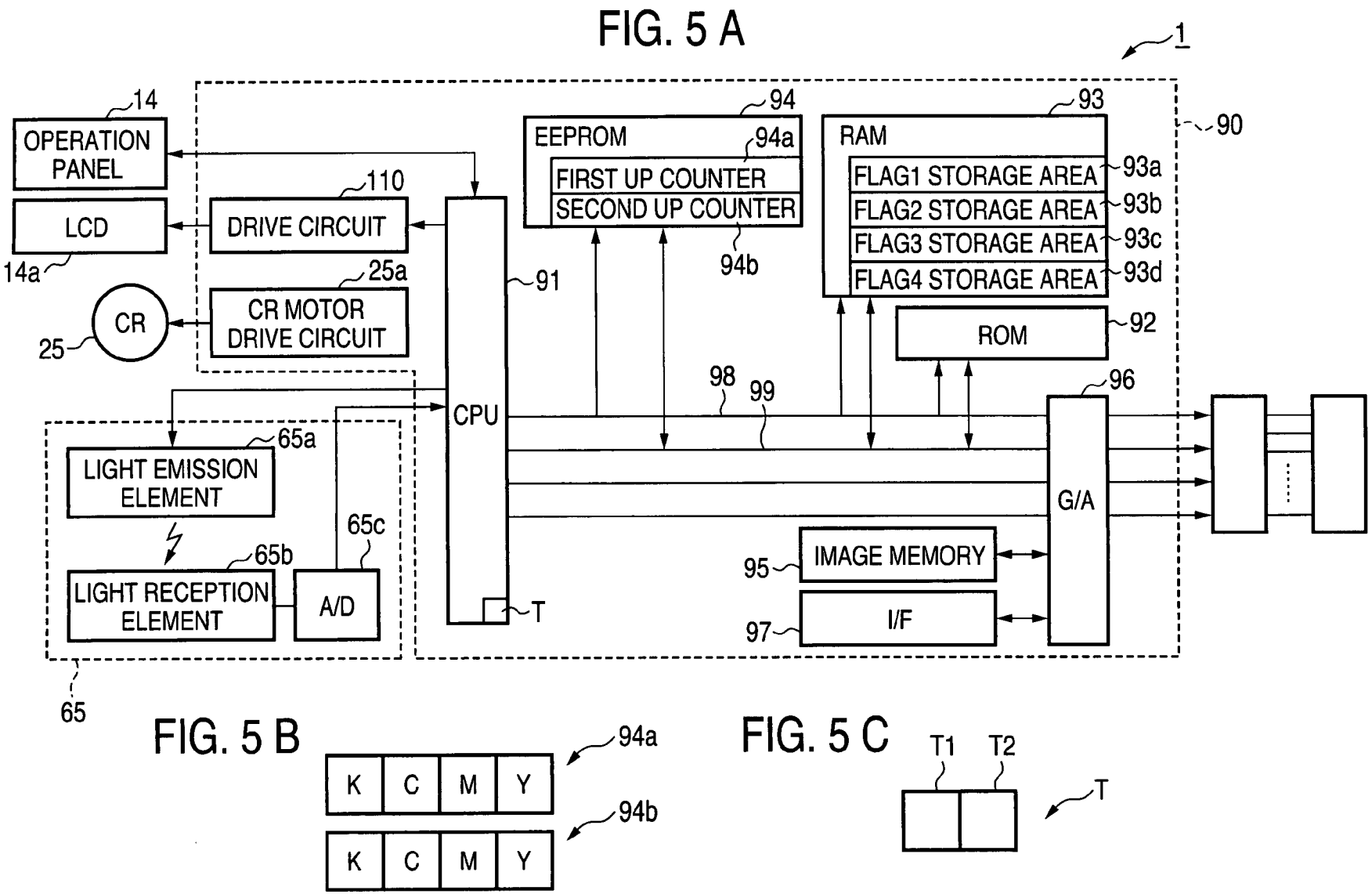
FIG. 5A is a block diagram to show a control system of the image record apparatus.
FIG. 5B is a conceptual drawing of first and second up counters.
FIG. 5C is a conceptual drawing of a timer T.
Figure 6:
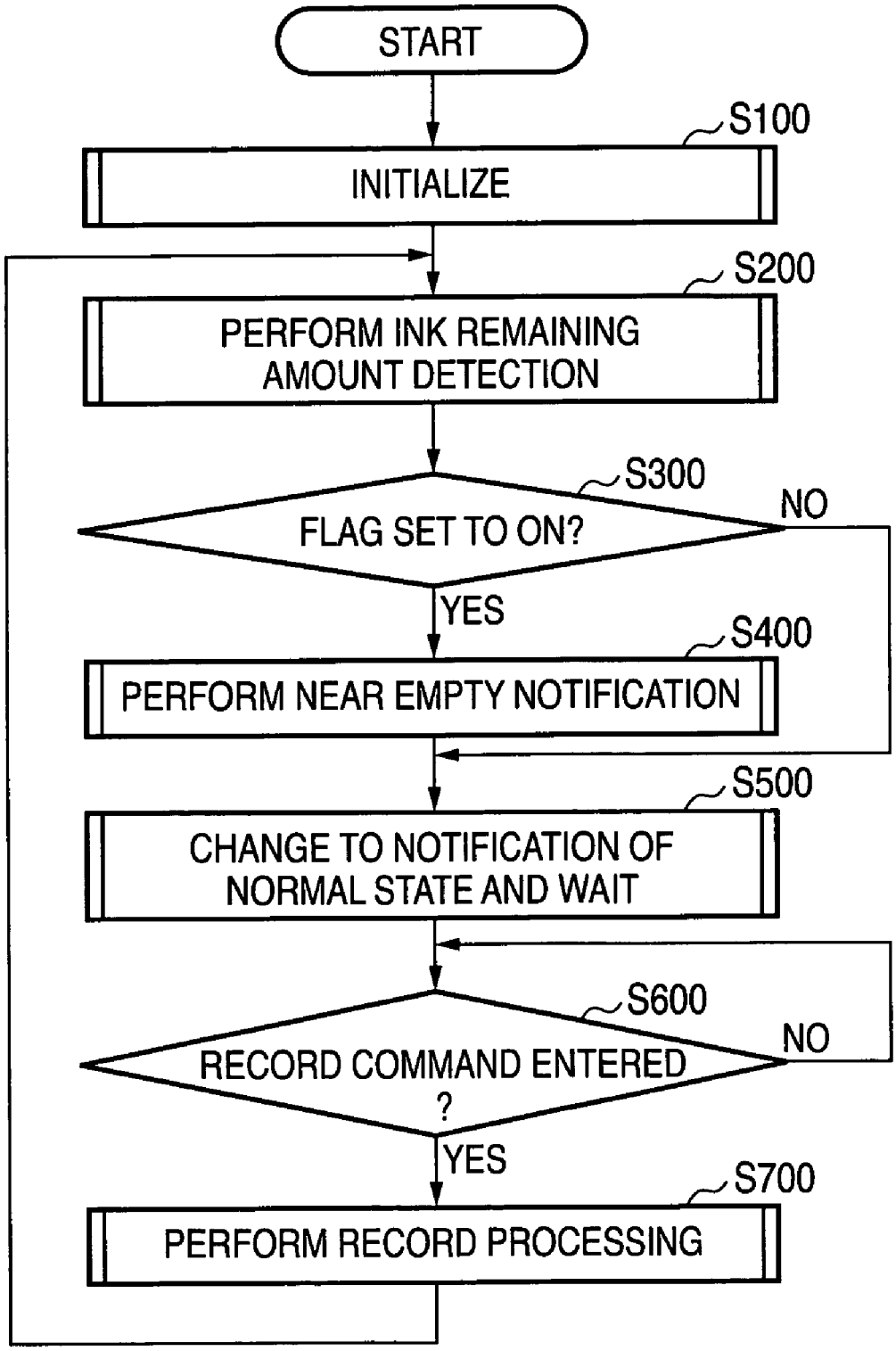
FIG. 6 is a flowchart to show schematic operation of the image record apparatus.
Figure 7:
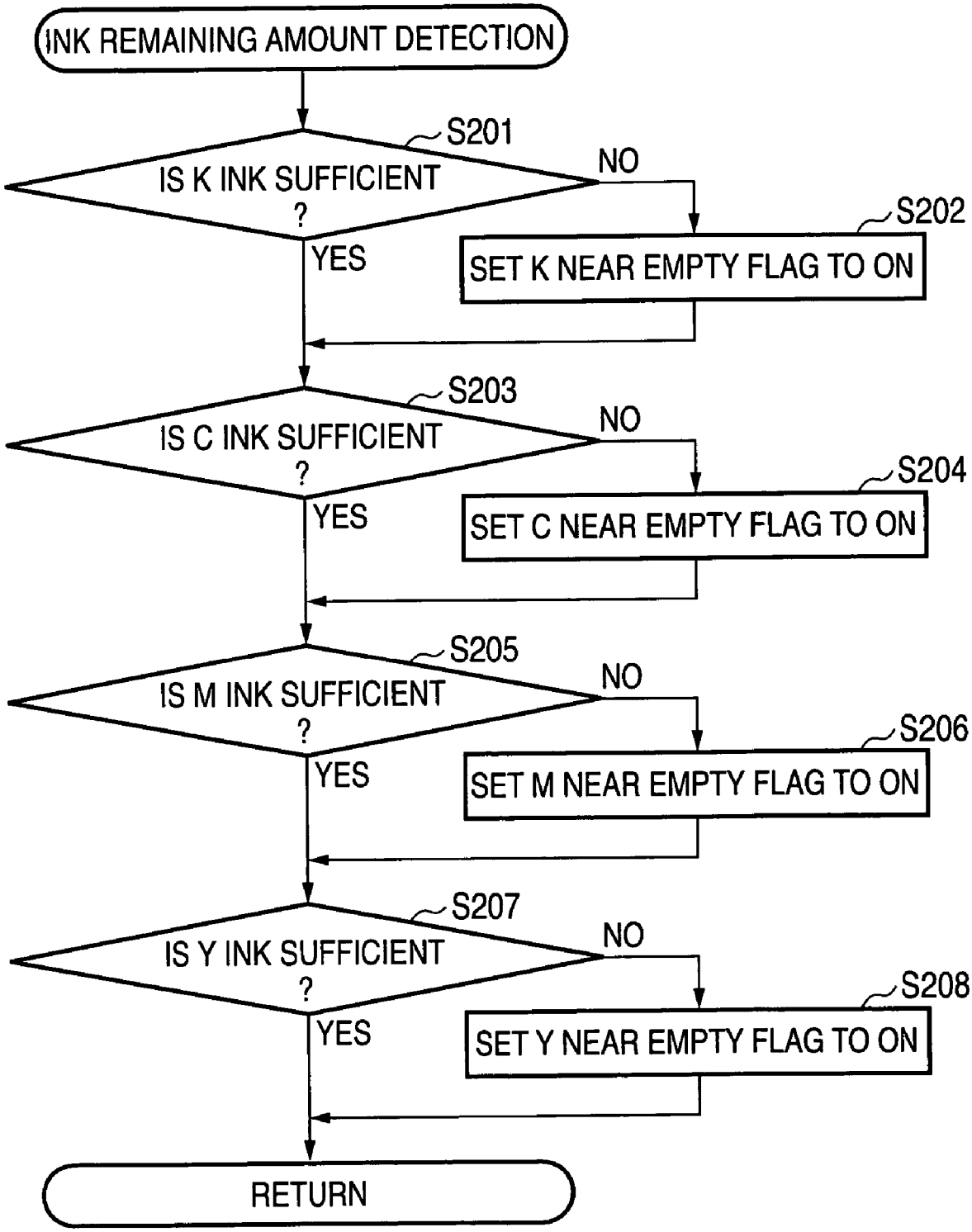
FIG. 7 is a flowchart to show ink remaining amount detection processing.

Referring now to the accompanying drawings, there are shown preferred embodiments of the invention. FIG. 1 is a perspective view of an image record apparatus of an embodiment of the invention, FIG. 2 is a sectional side view of the image record apparatus in FIG. 1, FIG. 3 is a perspective view of the image record apparatus in FIG. 1 from the rear with an image reader removed, FIG. 4 is a schematic sectional view of an ink cartridge used with the image record apparatus, FIG. 5 is a block diagram to show a controller of the image record apparatus, and FIG. 6 is a flowchart to show schematic operation of the image record apparatus.

The image record apparatus of the embodiment is provided by applying the invention to a multifunction device (MFD) 1 including a printer function, a copier function, a scanner function, a facsimile function, and the like.

As shown in FIG. 1, the MFD 1 has an image reader 12 deposited on the top of a record apparatus main unit 2 made of a synthetic resin. A paper feed cassette 3 that can be attached to and detached from the record apparatus main unit 2 through an opening 2*a* thereof is placed at the bottom of the record apparatus main unit 2. In the embodiment, a plurality of sheets of paper of record media cut to A4 size, letter size, legal size, postcard size, etc., for example, can be stacked on each other in the paper feed cassette 3. FIG. 1 shows a state in which an auxiliary support member 3*a* is stored in a storage section 3*b*; FIG. 2 shows a state in which the auxiliary support member 3*a* is drawn out from the storage section 3*b*. When the auxiliary support member 3*a* is drawn out from the storage section 3*b*, the trailing end of long paper of the legal size, etc., (projecting from the opening 2*a* to the outside of the record apparatus main unit 2) can be supported. To use paper of the A4 size, etc., fitting in the paper feed cassette 3 (not projecting from the opening 2*a* to the outside of the record apparatus main unit 2), the auxiliary support member 3*a* may be stored in the storage section 3*b* so as not to get in the way of paper feed, as shown in FIG. 1. Further, the top of the paper feed cassette 3 is also used as a paper ejection section 10 of paper with an image recorded thereon, as described later.

Figure 2:
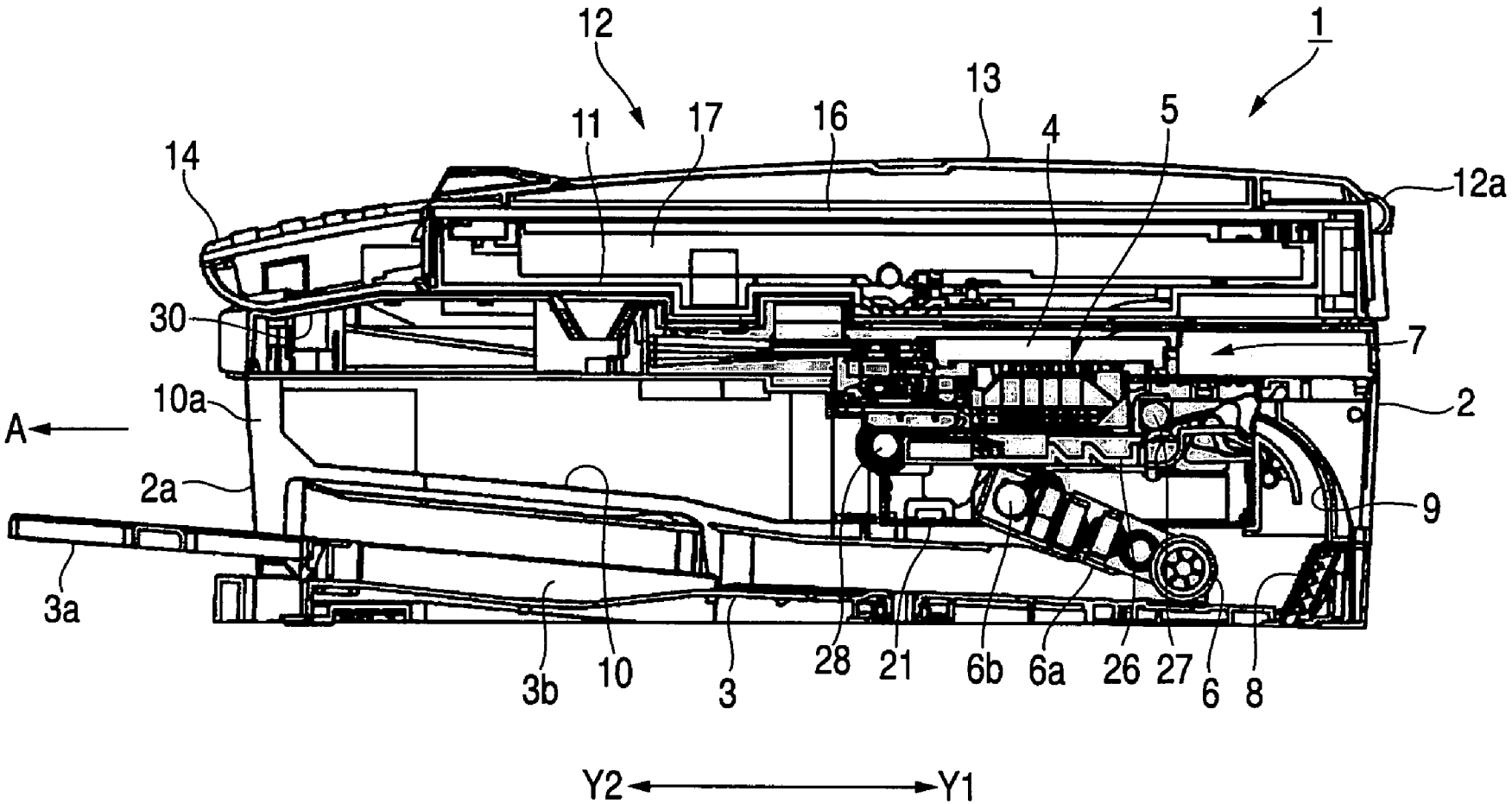
FIG. 2 is a sectional side view of the image record apparatus according to the embodiment of the invention.

A bank section 8 for paper separation is placed at the depth of the paper feed cassette 3 (Y1 direction) in FIG. 2. An arm 6*a* that can rotate up and down with a drive shaft 6*b* of a paper feed roller 6 at the rotation center is attached to a frame 21 fixed in the record apparatus main unit 2, and the sheets of paper stacked in the paper feed cassette 3 are transported separately one sheet at a time by the paper feed roller 6 provided at the lower end of the arm 6*a* and the bank section 8. A separated sheet of paper is delivered via an upward sideways U turn pass (paper feed passage) 9 to a record section 7 provided above (at a higher position than) the paper feed cassette 3. The record section 7 is made up of a reciprocatable carriage 5 on which an ink-jet record head 4 for implementing the printer function, etc., is mounted and the like. Paper recorded in the record section 7 and ejected with the record side up in the arrow A direction is placed an the paper ejection section 10 formed on the top of the paper feed cassette 3, and a paper ejection port 10*a* communicating with the paper ejection section 10 is provided on the front of the record apparatus main unit 2 (in the A direction or the Y2 direction).

The image reader 12 for reading an original, etc., in the copy function or the facsimile function is placed on the top of the record apparatus main unit 2. A bottom wall 11 of the image reader 12 is placed with almost no gap from above an upper cover body 30 covering the record apparatus main unit 2. The image reader 12 can rotate up and down with a pivot section (not shown) provided on one end side of the record apparatus main unit 2 (on the end side in the X2 direction shown in FIG. 1) as the center. With the image reader 12 opened upward, an ink cartridge 19 of an ink reservoir section 15 described later is replaced or paper jammed in the record section 7 is removed. Further, an original cover body 13 covering the top of the image reader 12 is attached so that it can rotate up and down with a pivot 12*a* provided on the rear end side (the Y1 side shown in FIG. 2) as the center.

On the top of the record apparatus main unit 2, an operation panel section 14 provided with a liquid crystal display (LCD) 14*a* of a notification member and various keys such as a numeric keypad 14*b*, a MENU/SET key 14*c*, arrow keys 14*d*, a STOP/EXIT key 14*e*, a START key 14*f*, a COPY MODE key 14*g*, a FAX MODE key 14*h*, and a SCANNER MODE key 14*i* is provided on the front of the image reader 12 (on the Y2 side). For the MENU/SET key 14*c* and the STOP/EXIT key 14*e*, a controller 90 (described later) automatically determines which function of each key the user intends in pressing the key depending on the situation in which the key is pressed. Further, if the user presses the mode switch key, namely, the COPY MODE key 14*g*, the FAX MODE key 14*h*, or the SCANNER MODE key 14*i*, the MFD (multifunction device) 1 is set to the function indicated by the pressed mode key. The record section 7, the paper ejection section 10, and the ink reservoir section 15 (see FIG. 3) provided on one side (X1 side) of the paper ejection section 10 are placed in the plan view projection area of the image reader 12 and the operation panel section 14. The length of the paper feed cassette 3 in the Y axis direction thereof is almost equal to "the length of the image reader 12 in the Y axis direction thereof plus the length of the operation panel section 14 in the Y axis direction thereof" in a state in which the auxiliary support member 3*a* is stored in the storage section 3*b*. Therefore, the MFD 1 becomes roughly a rectangular parallelepiped roughly like a square on a plan view, so that it can be easily packed at the packing time at the shipment as a product and the package box can also be miniaturized.

A placement glass plate 16 on which an original can be placed with the original cover body 13 opened upward is provided on the top of the image reader 12, and a contact image scanner (CIS) 17 for reading an original is provided below the placement glass plate 16 so that it can reciprocate in the X axis direction in FIG. 1 (the direction orthogonal to the plane of FIG. 2).

The ink reservoir section 15 is opened toward the top of the record apparatus main unit 2 as shown in FIG. 3. The ink reservoir section 15 can store ink cartridges 19, each shaped almost like a rectangular box, storing ink of four colors for full-color record (black (K) ink cartridge 19*a*, cyan (C) ink cartridge 19*b*, magenta (M) ink cartridge 19*c*, and yellow (Y) ink cartridge 19*d*) in one row along the Y axis direction, and the ink cartridges can be attached and detached from above the ink reservoir section 15. Ink is supplied from the ink cartridges 19 to the ink-jet record head 4 via a plurality of (since the number of the ink cartridges 19 is four in the embodiment, four) ink supply tubes (ink tubes) 20. To user more than four ink colors (six to eight colors, etc.,), the ink reservoir section 15 may be configured so as to be able to store as many ink cartridges as the number of the ink colors, and the number of the ink supply tubes 20 may be increased in response to the number of the ink cartridges 19.

As shown in FIGS. 2 and 3, the record section 7 includes horizontally oriented plate-like guide members 22 and 23 supported on a main frame 21 and extending in the x axis direction (main scanning direction), the above-mentioned carriage 5 slidably supported (mounted) across both the guide members 22 and 23 and made reciprocatable in the X axis direction (main scanning direction), a timing belt 24 placed downstream in a paper transport direction (arrow A direction) to reciprocate the carriage 5 with the record head 4 mounted thereon, a CR (carriage) motor 25 for driving the timing belt 24 (in the embodiment, a DC motor, but any other motor such as a stepping motor may be adopted), a plate-like platen 26 for supporting transported paper on the lower face of the record head 4, an encoder strip 47 placed so as to extend along the main scanning direction for detecting the position of the carriage 5 in the X axis direction (main scanning direction), and the like. A registration roller pair 27 is placed upstream in the paper transport passage (on the Y1 side) with the platen 26 between, and a paper ejection roller 28 is placed downstream in the paper transport passage (on the Y2 side) with the platen 26 between. The registration roller pair 27 is a roller pair for transporting a sheet of paper separately transported from the paper feed cassette 3 by the paper feed roller 6 to the nip between the record head 4 and the platen 26. The paper ejection roller 28 transports paper recorded in the record section 7 to the paper ejection section 10 in cooperation with a spur roller (not shown).

Next, a schematic configuration of the ink cartridge 19 of the embodiment and how the ink remaining amount in the ink cartridge 19 is detected by an ink remaining amount sensor 65 will be discussed briefly with reference to FIG. 4. First, a mechanism for detecting the ink remaining amount in the ink cartridge 19 by the ink remaining amount sensor 65 will be discussed briefly.

The ink cartridges 19*a* to 19*d* are placed in the ink reservoir section 15 as described above. Each ink supply tube 15*a* and each atmosphere introduction tube 15*b* are placed upright at the position of the bottom of the ink reservoir section 15 where the ink cartridges are placed. The ink supply tube 15*a* and the atmosphere introduction tube 15*b* are provided at the positions corresponding to an ink supply valve 51 and an atmosphere introduction valve 52 (described later) provided in the ink cartridge 19. The ink reservoir section 15 is also provided with optical ink remaining amount sensors 65 each for detecting the ink remaining amount in the ink cartridge 19. The ink remaining amount sensors 65 as a detection member are provided in a one-to-one correspondence with the ink cartridges 19*a* to 19*d*. Each ink remaining amount sensor 65 includes a light emission element 65*a* and a light reception element 65*b* opposed to each other so as to sandwich a light shield plate (douser) 60 of a shutter mechanism 53 (described later) in a projection section 54 of the ink cartridge 19. The ink remaining amount sensor 65 detects whether or not light front the light emission element 65*a* is intercepted by the shutter mechanism 53 provided in the ink cartridge 19, and outputs the detection result to the control section 90 (described later).

Next, the configuration of the ink cartridge 19 will be discussed briefly. The ink cartridges 19 include the black ink cartridge 19*a* and other three color ink cartridges 19*b* to 19*d* as described above; in fact, the black ink cartridge 19*a* has a larger ink capacity than any of the three color ink cartridges 19*b* to 19*d*, but the ink cartridges 19*a* to 19*d* have almost the same structure and therefore one ink cartridge 19 will be discussed.

The ink cartridge 19 includes a cartridge main body 50*a* for storing ink, the above-mentioned ink supply valve 51 capable of opening and closing an ink supply flow passage for supplying ink in the cartridge main body 50*a* to the record head 5, the above-mentioned atmosphere introduction valve 52 capable of opening and closing an atmosphere introduction passage for introducing the atmosphere into the cartridge main body 50*a* from the outside, and the above-mentioned shutter mechanism 53 for intercepting light from the light emission element 65*a* of the ink remaining amount sensor 65, as shown in FIG. 4.

The cartridge main body 50*a* is formed of a synthetic resin having light transmission. A partition wall 70 horizontally extending is formed integrally in the cartridge main body 50*a* for partitioning the internal space of the cartridge main body 50*a* into an upper ink chamber 71 and two lower valve housing chambers 72 and 73, as shown in FIG. 4. The ink chamber 71 fills with ink of the corresponding color and the ink supply valve 51 and the atmosphere introduction valve 52 are housed in the two valve housing chambers 72 and 73. The projection section 54 projecting slightly to the outside is formed roughly at the center position in the height direction of a side wall part of the cartridge main body 50*a*. The light shield plate (douser) 60 of the shutter mechanism 53 (described later) is placed in the space of the projection section 54. The projection section 54 is sandwiched between the light emission element 65*a* and the light reception element 65*b* of the ink remaining amount sensor 65 in a state in which the ink cartridge 19 is placed in the ink reservoir section 15. Since a lid member 50*b* (see FIG. 3) is welded to an upper end part of the cartridge main body 50*a*, the ink chamber 71 in the cartridge main body 50*a* is closed by the lid member 50*b*.

An injection hole 76 for injecting ink into the ink chamber 71 of an empty ink cartridge 19 is formed between the valve housing chambers 72 and 73, and a stopper member 77 made of synthetic rubber is pressed into the injection hole 76. A communication hole 76*a* for allowing the injection hole 76 and the ink chamber 71 in the cartridge main body 50*a* to communicate with each other is made in the depth end of the injection hole 76. The manufacturer of the ink cartridge 19 makes an injection needle (not shown) penetrate through the stopper member 77 in the injection hole 76 and fills ink into the ink chamber 71 through the injection needle. After filling ink into the ink chamber 71, the manufacturer pulls out the injection needle from the stopper member 77 and thus the communication hole 76*a* is hermetically sealed by the stopper member 77, preventing the ink from leaking from the inside of the ink chamber 71.

In the portion of the partition wall 70 forming the sealing part of the valve housing chamber 72 in which the ink supply valve 51 is housed, a tubular part 78 projecting downward is formed integrally, and a thin film part 79 for blocking a communication passage formed in the tubular part 78 is provided in the lower end inside of the tubular part 78. On the other hand, in the portion of the partition wall 70 forming the sealing part of the valve housing chamber 73 in which the atmosphere introduction valve 52 is housed, two tubular parts 80 and 81 projecting upward and downward are formed integrally, and a thin film part 82 for blocking a communication passage formed in the tubular parts 80 and 81 is provided in the lower and inside of the lower tubular part 81. Further, a tube member 83 extending to the upper end part of the ink chamber 71 is provided above the tubular part 80.

When the ink cartridge 19 is placed in the ink reservoir section 15, first the ink supply tube 15*a* and the atmosphere introduction tube 15*b* provided in the ink reservoir section 15 are inserted into guidance holes 51*a* and 52*a* of the ink supply valve 51 and the atmosphere introduction valve 52 respectively. Further, as the ink cartridge 19 is pressed downward, the ink supply valve 51 and the atmosphere introduction valve 52 are pressed upward by the ink supply tube 15*a* and the atmosphere introduction tube 15*b*, and projections 51*b* and 52*b* at the tips of the ink supply valve 51 and the atmosphere introduction valve 52 break the thin film parts 79 and 62 respectively. Then, the ink in the ink chamber 71 flows into the valve housing chamber 72 through the communication passage in the tubular part 78 and further is supplied to the record head 5 through the ink supply tube 15*a*. The atmosphere introduction valve 52 also has a similar configuration to that of the ink supply valve 51; the external atmosphere flows into the valve housing chamber 73 through the atmosphere introduction tube 15*b* and further is introduced into the top of the ink chamber 71 through the internal passage of the tubular parts 80 and 81 and the tube member 83.

The shutter mechanism 53 is provided in the lower space of the ink chamber 71. It is made up of the above-mentioned light shield plate (douser) 60 for allowing no light to pass through, a hollow float 61, a joint member 62 for joining the light shield plate 60 and the float 61, and a support bed 63 provided on the top of the partition wall 70 for pivotally supporting the joint member 62. The light shield plate 60 and the float 61 are provided at both end parts of the joint member 62, and the joint member 62 is disposed so that it can rock within the vertical plane parallel to the plane of FIG. 4 with a pivotal support point 64 of the support bed 63 as the center.

The light shield plate 60 is a thin-plate member parallel to the vertical plane and having a predetermined area. By the way, with the ink cartridge 19 placed in the ink reservoir section 15, the light emission element 65*a* and the light reception element 65*b* of the ink remaining amount sensor 65 provided in the ink reservoir section 15 are positioned at the height equal to the height of the projection section 54 formed on the side wall part of the cartridge main body 50*a*, as shown in FIG. 4. When the light shield plate 60 is positioned in the space in the projection section 54, the light shield plate 60 intercepts light passing through the translucent wall part of the cartridge main body 50*a* and the ink in the ink chamber 71 from the light emission element 65*a* of the ink remaining amount sensor 65. The float 61 is a cylindrical member filling with air and the whole specific gravity of the float 61 is smaller than the specific gravity of the ink in the ink chamber 71. Therefore, in a state in which the ink remaining amount in the ink chamber 71 is large and the whole of the float 61 provided at one end of the joint member 62 is positioned in the ink, the float 61 floats by buoyant force and thus the light shield plate 60 provided at an opposite end of the joint member 62 is placed at a position for intercepting the light from the light emission element 65*a* in the projection section 54 (solid line position in FIG. 4). Thus, the light reception element 65*b* cannot receive the light from the light emission element 65*a*. On the other hand, when the ink remaining amount in the ink chamber 71 becomes small and apart of the float 61 is exposed from the liquid level of the ink, the buoyant force acting on the float 61 becomes small and the float 61 moves down. Then, the light shield plate 60 mover to a position not intercepting the light from the light emission element 65*a*, above the inside of the projection section 54 (alternate long and short dashed line position in FIG. 4). Consequently, the light from the light emission element 65*a* is not intercepted by the light shield plate 60 and passes through the ink chamber 71 and is received at the light reception element 65*b*. Thus, the ink remaining amount sensor 65 detects that the ink remaining amount in the ink chamber 71 is near empty.

Next, the control system of the MFD 1 described above will be discussed with reference to FIGS. 5A and 5B. The controller 90 of a control member for controlling the MFD 1 is installed on a main board (not shown) placed in the record apparatus main unit 2. The controller 90 has a one-chip microcomputer (CPU) 91, ROM 92 storing various control programs executed by the CPU 91 and fixed value data, RAM 93 of a storage member for temporarily storing various pieces of data, etc., EEPROM 94 of rewritable nonvolatile memory, image memory 95, a gate array 96, and the like. The EEPROM 94 includes a first up counter 94*a* and a second up counter 94*b*. The RAM 93 of the storage member includes a FLAG1 storage area 93*a*, a FLAG2 storage area 93*b*, a FLAG3 storage area 93*c*, and a FLAG4 storage area 93*d*. The first up counter 94*a* counts the total number of ejection times since replacement of the ink cartridge 19 and is divided into four areas corresponding to the ink cartridges 19 of four colors (black, cyan, magenta, and yellow), as shown in FIG. 5B. Therefore, the total number of ejection times since replacement of the ink cartridge 19 can be counted for each ink color. The second up counter 94*b* counts the total number of ejection times since detection of a near empty state of ink and is divided into four areas corresponding to the ink cartridges 19 of four colors like the first up counter 94*a*, as shown in FIG. 5B. Therefore, the total number of ejection times since detection of near empty can be counted for each ink color. The first up counter 94*a* is a counter for displaying the ink remaining amount (described later) on the LCD 14*a* on the operation panel section 14, and the second up counter 94*b* is a counter for more precisely detecting actual empty from near empty. That is, the actual empty state can be detected more precisely if the number of ink ejection times is detected after detection of a near empty state closer to empty rather than detection of an ink empty state based on the total number of ejection times since replacement of the ink cartridge 19 (namely, ink full state) only with the first up counter 94*a*.

The FLAG1 storage area 93*a* to the FLAG4 storage area 93*d* in the RAM 93 are areas storing flags indicating whether or not the ink remaining amounts in the color ink cartridges 19*a* to 19*d* are near empty. The CPU 91 performs control described later based on the flag information stored in the FLAG1 storage area 93*a* to the FLAG4 storage area 93*d* in the RAM 93.

A black ink near empty flag FLAG1 is stored in the FLAG1 storage area 93*a* in the RAM 93. The near empty flag FLAG1 is a flag indicating that the ink remaining amount in the black ink cartridge 19*a* is in a near empty state. When the ink remaining amount is equal to or greater than the reference amount, "0" is stored in the FLAG1 storage area 93*a*; when the ink remaining amount is less than the reference amount, "1" is stored in the FLAG2 storage area 93*a*.

A cyan ink near empty flag FLAG2 is stored in the FLAG2 storage area 93*b*. The near empty flag FLAG2 is a flag indicating that the ink remaining amount in the cyan ink cartridge 19*b* is in a near empty state. When the ink remaining amount is equal to or greater than the reference amount, "0" is stored in the FLAG2 storage area 93*b*; when the ink remaining amount is less than the reference amount, "1" is stored in the FLAG2 storage area 93*b*.

Likewise, a magenta ink near empty flag FLAG3 is stored in the FLAG3 storage area 93*c*, and a yellow ink near empty flag FLAG4 is stored in the FLAG4 storage area 93*d*. The near empty flags FLAG3 and FLAG4 are also flags indicating that the ink remaining amount in the magenta ink cartridge 19*c* is in a near empty state and that in the yellow ink cartridge 19*d* is in a near empty state respectively. When the ink remaining amount is equal to or greater than the reference amount, "0" is stored in the FLAG3 storage area 93*c*, FLAG4 storage area 93*d*; when the ink remaining amount is less than the reference amount, "1" is stored in the FLAG3 storage area 93*c*, FLAG4 storage area 93*d*.

The CPU (central processing unit) 91 executes control for detecting the presence or absence of ink in accordance with the control program previously stored in the ROM 92. The CPU 91 also generates an image formation timing signal and a reset signal and transfers the signals to the gate array 96. The operation panel section 14 for the user to enter an image formation command, a motor drive circuit 25*a* for driving the carriage motor (CR motor) 25 for operating the carriage 5, the ink remaining amount sensor 65, and the like are connected to the CPU 91. The operation of the devices connected to the CPU 91 is controlled by the CPU 91. The CPU 91 and the ROM 92, the RAM 93, the EEPROM 94, and the gate array 96 are connected via an address bus 98 and a data bus 99. An interface 97 for connecting to an external system is also connected to the gate array 96. In addition, a motor drive circuit for driving a transport motor (LF motor) for transporting paper, a paper sensor for detecting the leading end of paper, an origin sensor for detecting the origin position of the carriage 5, and the like are also connected to the CPU 91, but are not required on the description of the invention and therefore will not be discussed.

Next, the operation of detecting the ink remaining amounts of the ink cartridges 19*a* to 19*d* using the first and second up counters 94*a* and 94*b* and the ink remaining amount sensors 65 corresponding to the ink cartridges 19*a* to 19*d* will be discussed.

As described above, the first up counter 94*a* and the second up counter 94*b* are provided in the EEPROM 94 and are memory for counting the number of ejection times of ink from the record head 4 although they differ in count start timing. Each counter is incremented by one each time the number of election times of ink is counted one. However, for an image record apparatus capable of varying the size of an ejected ink droplet, the increment value may be made variable in response to the size of an ink droplet.

Initially, a predetermined amount of ink 71 is filled into each color ink cartridge 19, and the approximate maximum number of ink ejection times is determined from the filled ink amount. Thus, when the ink cartridge 19 is replaced, the first up counter 94*a* and the second up counter 94*b* corresponding to the replaced ink cartridge 19 are cleared to zero. First, only the first up counter 94*a* is started to count the number of ejection times. Whenever ink is ejected, the first up counter 94*a* increments the number of ink ejection times by one and the approximate consumption amount based on the count can be displayed on the LCD 14*a* through a drive circuit 110. If the user executes operation of entering a mode of seeing the ink remaining amount for each color through the operation panel section 14 and specifies the ink color whose remaining amount to know, the approximate ink remaining amount is displayed for each ink color on the LCD 14*a* on the operation panel section 14.

Each ink remaining amount sensor 65 detects the ink remaining amount of the ink cartridge 19 of the corresponding color. When the ink remaining amount of one color becoming near empty is detected, the second up counter 94*b* corresponding to the color starts to count the number of ink ejection times.

As described above, the ink filled in the initial state is consumed gradually each time record is executed and when it is made impossible for the light shield plate 60 to shield the light from the light emission element 65*a*, the light amount detected at the light reception element 65*b* grows largely. The detected light amount is converted into a digital signal by an A/D converter 65*c* and the digital signal is input to the CPU 91, which then recognizes the change as near empty, and the near empty flag (FLAG1 to FLAG4) corresponding to the ink color whose near empty state is detected is Set to ON. That is, 1 is stored in the corresponding FLAG storage area of the FLAG1 storage area 93*a* to the FLAG4 storage area 93*d* in the RAM 93.

When the near empty flag is set to ON (the ink remaining amount becomes near empty), the ink in the ink cartridge 19 does not become completely empty. Then, further image record can be continued until the apparently actual ink empty state (the number of ink ejection times of the second up counter 94*b* reaches an empty threshold value). Therefore, when the count of the second up counter 94*b* reaches the empty threshold value, the control section 90 determines that the ink remaining amount of the ink color becomes empty, displays INK EMPTY on the LCD 14*a*, and also displays REPLACE CARTRIDGE of the ink color, thereby prompting the user to replace the ink cartridge 19. In this case, if it is determined that the remaining amount of black ink becomes empty, it is made impossible to use every function of the multifunction device 1 using ink jet record. However, if it is determined that at least one of other ink colors (cyan, magenta, yellow) becomes empty, the functions of the multifunction device 1 that can be executed only with black ink, such as monochrome copy and monochrome FAX can be continuously executed.

Next, schematic operation of the MFD 1 of the embodiment will be discussed with reference to FIGS. 6 to 9. The flow shown in FIG. 6 is started when power of the MFD 1 is turned on.

When the power is turned on, first the MFD 1 is initialized (S100). The operation of the initialization is known and therefore will not be discussed here in detail. The FLAG1 storage area 93*a* to the FLAG4 storage area 93*d* in the RAM 93 are also cleared to 0.

Next, ink remaining amount detection processing of each ink cartridge 19 is performed (S200). The ink remaining amount detection processing will be discussed with reference to FIG. 7. In the ink remaining amount detection processing, a determination is made as to whether or not the light reception element 65*b* of the ink remaining amount sensor 65 for each color receives a large amount of light from the light emission element 65*a*, as described above.

First, whether or not black (K) ink is sufficient, namely, is in a near empty state is determined, (S201). If the light reception amount of the light reception element 65*b* is large, it means that the light shield plate 60 is not positioned between the light emission element 65*a* and the light reception element 65*b* and thus the fact that the black ink is in a near empty state is detected (NO at S201). Then, "1" is stored in the FLAG1 storage area 93*a* in the RAM 93 (S202). That is, the black ink near empty flag is set to ON. On the other hand, if the light reception amount of the light reception element 65*b* scarcely exists, it means that the light shield plate 60 is positioned between the light emission element 65*a* and the light reception element 65*b* and thus the fact that the black ink is not in a near empty state is detected (YES at S201). Then, "1" is not stored in the FLAG1 storage area 93*a* in the RAM 93, namely, "0" remains stored in the FLAG1 storage area 93*a* in the RAM 93 and the process goes to S203. S201 and S202 are near empty determination processing for the black ink cartridge 19*a* using the ink remaining amount sensor 65. Likewise, S203 and S204 are near empty determination processing for the cyan ink cartridge 19*b*, S205 and S206 are near empty determination processing for the magenta ink cartridge 19*c*, and S207 and S208 are near empty determination processing for the yellow ink cartridge 19*d*. The determination processing steps are almost similar. When the fact that cyan ink is in a near empty state is detected (NO at S203), "1" is stored in the FLAG2 storage area 93*b* in the RAM 93 (S204). When the fact that magenta ink is in a near empty state is detected (NO at S205), "1" is stored in the FLAG3 storage area 93*c* in the RAM 93 (S206). When the fact that yellow ink is in a near empty state is detected (NO at S207), "1" is stored in the FLAG4 storage area 93*d* in the RAM 93 (S208).

The ink remaining amount detection processing (S200) is now complete. Then, whether or not at least one flag is set to ON, namely, whether or not "1" is set in at least one of the FLAG1 storage area 93*a* to the FLAG4 storage area 93*d* in the RAM 93 is determined (S300). If none of the flags are set to ON (NO at S300), the process goes to S500; if one or more flags are set to ON (YES at S300), near empty notification processing (S400) is executed. The near empty notification processing will be discussed with reference to FIG. 8. When the near empty notification processing is executed, first the time count of a timer T in the CPU 91 is cleared to zero and then the timer T starts to count the time (S401).

Figure 9A:
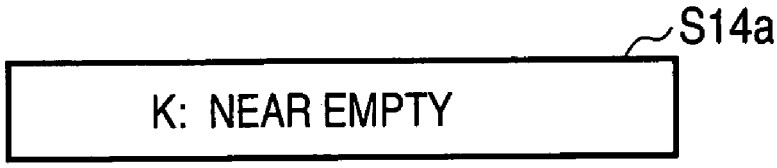
FIGS. 9A to 9D are drawings to show display on a liquid crystal display (LCD) for notifying the user of near empty state.
Figure 9B:
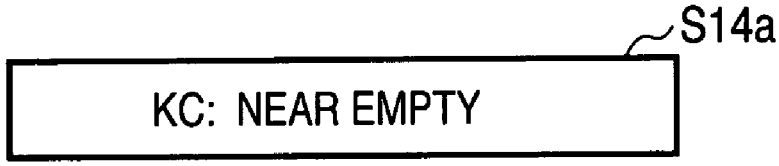
Figure 9C:
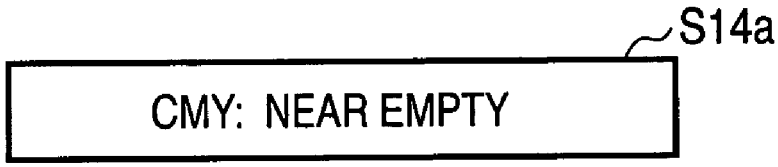
Figure 9D:
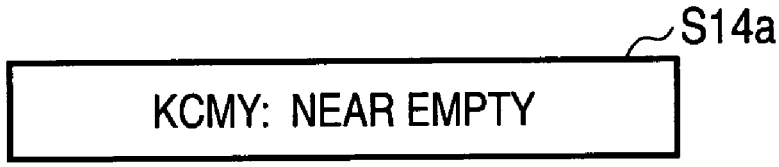

Near empty is displayed on the LCD based on each storage area of the FLAG1 storage area 93*a* to the FLAG4 storage area 93*d* in the RAM 93 in which "1" is stored (S402). For example, if "1" is stored only in the FLAG1 storage area 93*a*, a message of "K: NEAR EMPTY" is displayed on the LCD 14*a* as shown in FIG. 9A. If "1" is stored only in the FLAG1 storage area 93*a* and the FLAG2 storage area 93*b*, a message of "KC: NEAR EMPTY" is displayed on the LCD 14*a* as shown in FIG. 9B. If "1" is stored in the FLAG2 storage area 93*b* to the FLAG4 storage area 93*d*, a message of "CMY: NEAR EMPTY" is displayed on the LCD 14*a* as shown in FIG. 9C. Further, if "1" is stored in all of the FLAG1 storage area 93*a* to the FLAG4 storage area 93*d*, a message of "KCMY:NEAR EMPTY" is displayed on the LCD 14*a* as shown in FIG. 9D.

Next, whether or not the time count of the timer T reaches 60 seconds is determined (S403). If the time count of the timer T does not reach 60 seconds (NO at 8403), near empty is continuously displayed on the LCD 14*a*. When time count of the timer T reaches 60 seconds (YES at S403), the display of near empty is stopped (S404) and the process goes to S500.

Here, display on the LCD 14*a* is only produced as the notification member of near empty. However, the user may be notified of the near empty state by voice from a speaker (not shown) based on each storage area of the FLAG1 storage area 93*a* to the FLAG4 storage area 93*d* in the RAM 93 in which "1" is stored, or a plurality of LEDs may be provided in a one-to-one correspondence with the ink colors so that the LED corresponding to the ink whose near empty state is detected is lit.

Figure 10:
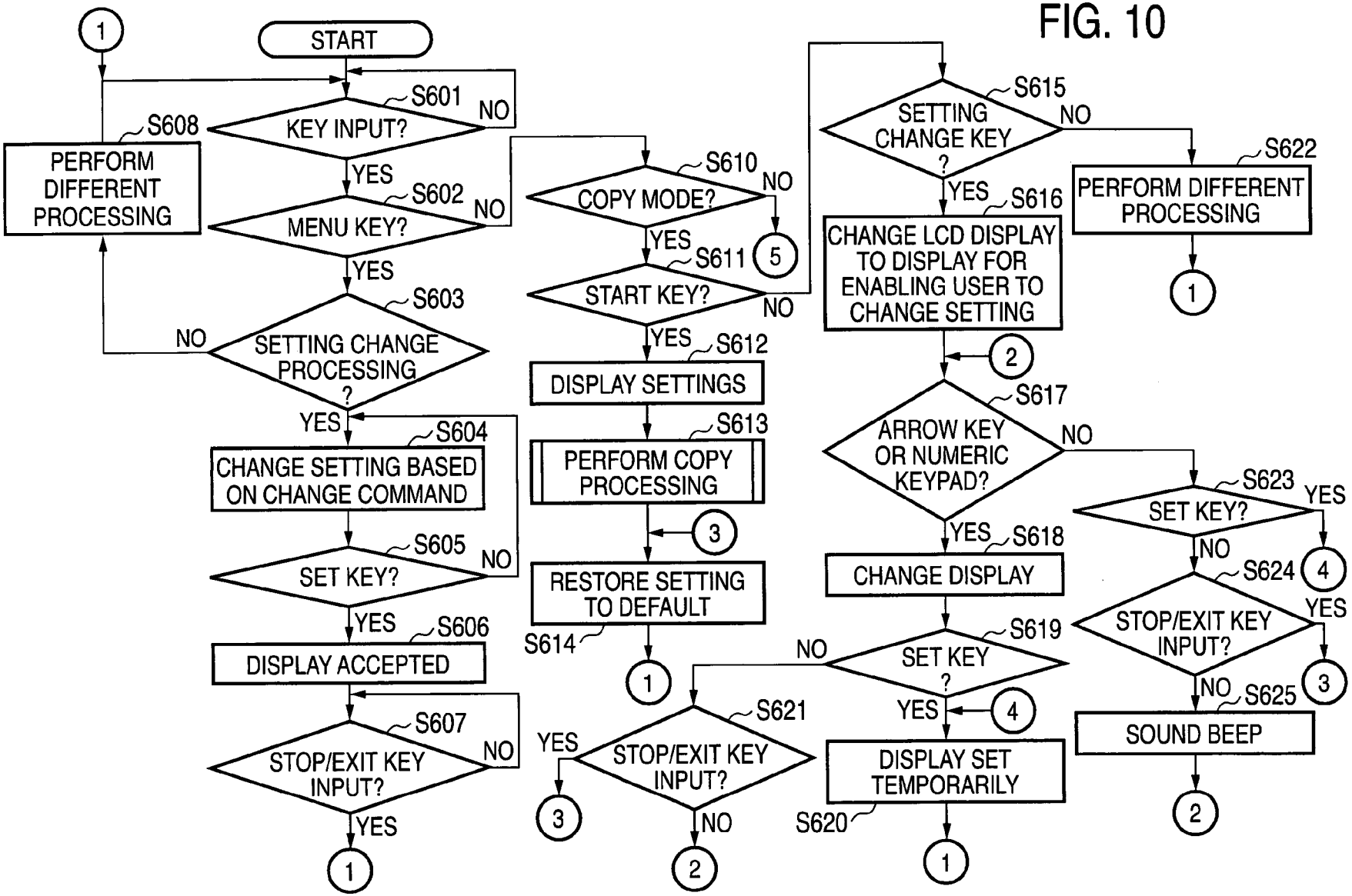
FIG. 10 is a flowchart to show a part of setting change processing of the image record apparatus.

Referring again to FIG. 6, at S500, notification of the normal state, namely, the date, the time, and the standby mode of the current MFD 1 are displayed on the LCD 14*a*, as shown in FIG. 10. For example, if the user sets the mode to FAX-dedicated mode, a message of "02/21 14:35 FAX" is displayed on the LCD 14*a*. It indicates that the present date and time are February 21, 14 hours and 35 minutes and the standby mode of the MFD 1 is set to the FAX-dedicated mode. In addition, if the MFD 1 includes a cord handset or a cordless handset, namely, also includes the telephone function, the display of the date and time can be followed by display of TAD indicating an answering machine mode, F/T indicating an automatically switchable mode between a FAX automatic reception mode and the answering machine mode, MNL indicating a manual mode, etc. Therefore, after ink near empty is displayed on the LCD 14*a* for a predetermined time (in the embodiment, 60 seconds), the date, the time, and the standby mode of the current MFD 1 (namely, information concerning the current function of the MFD 1) are displayed on the LCD 14*a*, so that the user can recognize the ink color of the ink entering the near empty state and can also keep track of the current function state of the MFD 1 and thus extreme ease of use can be provided.

In the standby state in which the current function state of the MFD 1 is displayed on the LCD 14*a*, whether or not a copy command or a record command from an external PC or the like is entered is determined (S600). If no record command is entered (NO at S600), the current function state of the MFD 1 is continuously displayed on the LCD 14*a*. However, if a record command is entered (YES at S600), record processing is performed in accordance with the command (S700). A message of "RECORDING" or the like is displayed on the LCD 14*a* during the operation of the record processing. Upon completion of the record processing, again the process returns to S200 and the ink remaining amount detection processing is performed. Therefore, in the embodiment, whenever the power of the MFD 1 is turned on and whenever the record processing is complete, the ink remaining amount is detected. If ink near empty is detected, the user is repeatedly notified of the near empty state each time a record command occurs, so that the user can reliably recognize the ink near empty state.

Figure 11:
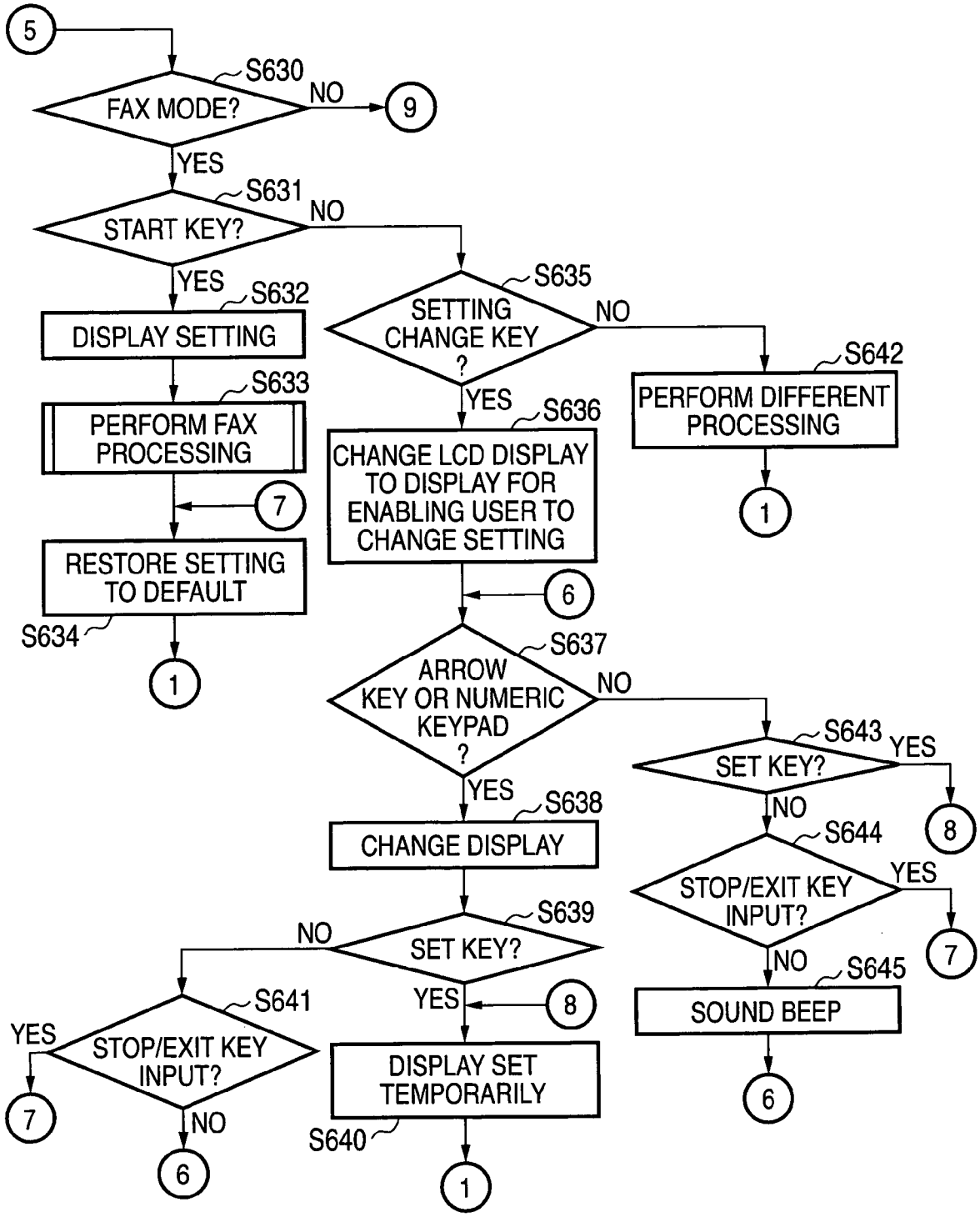
FIG. 11 is a flowchart to show a part of setting change processing of the image record apparatus.
Figure 12:
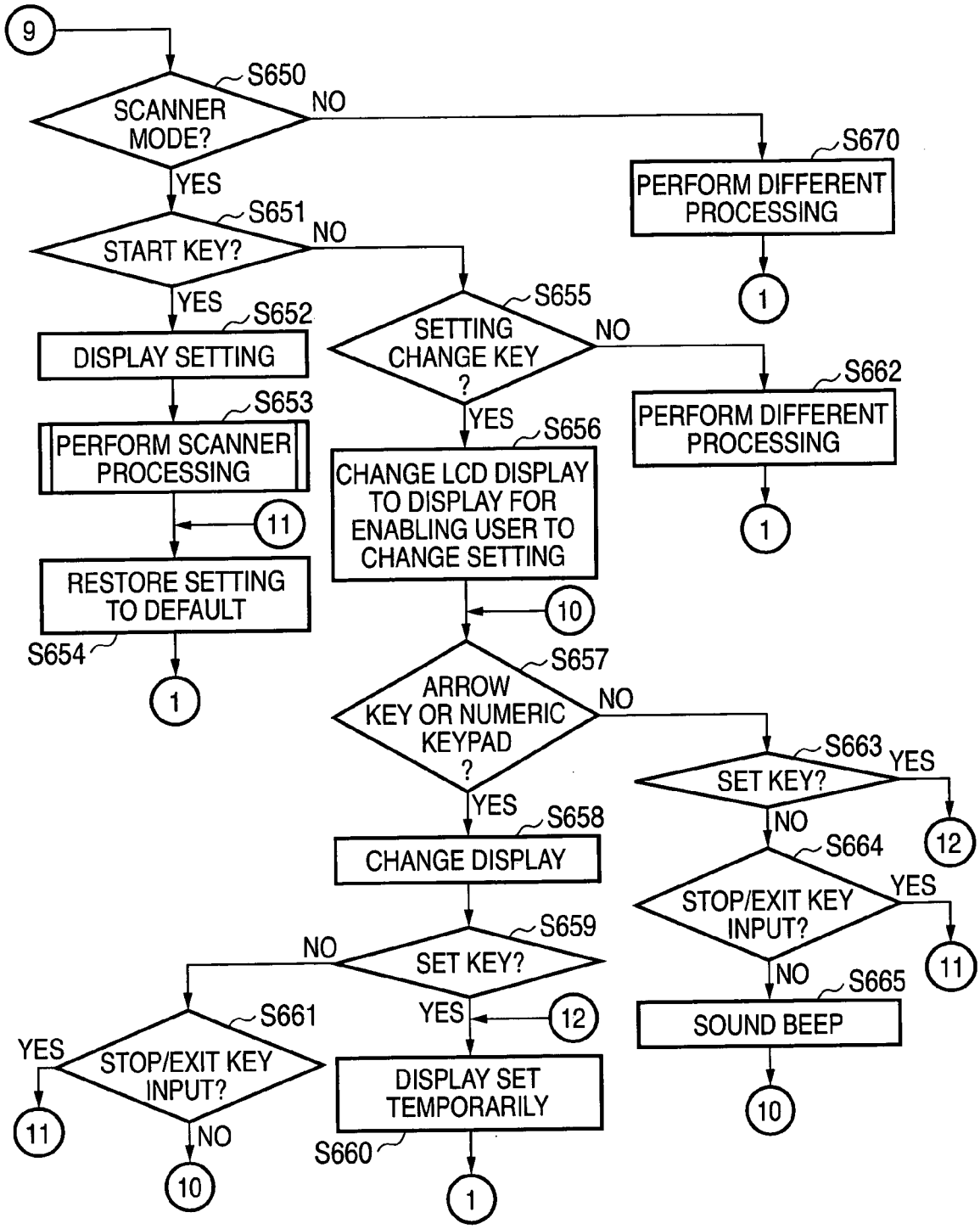
FIG. 12 is a flowchart to show a part of setting change processing of the image record apparatus.

In the described embodiment, brief description has been given as the current function state of the MFD 1 is displayed on the LCD 14*a* and the standby mode is entered at S500 and then whether or not a copy command or a record command from an external PC or the like is entered is determined at S600. In fact, however, more complicated processing is performed. Then, S600 will be discussed in detail with reference to FIGS. 10 to 12.

In the MFD 1 in the standby state with the current function state displayed on the LCD 14*a* at S500 first whether or not the user inputs any key through the operation panel section 14 is determined (S601), and the standby state is continued until the user inputs any key (NO at S601). When the user inputs any key through the operation panel section 14 (YES at S601), whether or not the input key is the MENU key 14*c* is determined (S602). If the input key is the MENU key 14*c* (YES at S602), a MENU screen for enabling the user to set the MFD 1 is displayed on the LCD 14*a*. Then, whether or not the user selects setting change processing for enabling the user to permanently change settings of the MFD 1 by using the up and down and left and right ARROW keys 14*d* and the SET key 14*c* in combination is determined (S603). If it is determined that the user selects setting change processing (YES at S603), the current settings of the MFD 1 are displayed on the LCD 14*a*. Then, the display on the LCD 14*a* is changed based on the change command entered by the user through the operation panel section 14 (S604). Whether or not the user presses the SET key 14*c* is determined (S605). If the user does not press the SET key 14*c* (NO at S605), S604 is repeated. If the user presses the SET key 14*c* (YES at S605), a message of "Accepted" is displayed on the LCD 14*a*, notifying the user that the settings of the MFD 1 have been charged permanently rather than temporarily (S606). The message "Accepted" is continuously displayed on the LCD 14*a* until the user inputs the STOP/EXIT key 14*e* through the operation panel section 14 (s607). When the user inputs the STOP/EXIT key 14*e* through the operation panel section 14 (YES at S607), the process returns to S601 and again the standby state is entered until the user inputs any key. On the other hand, if the user selects different processing rather than the setting change processing (NO at S603) after pressing the MENU key 14*c* (YES at S602), different processing other than the setting change processing is executed (S608) and the process returns to S601. In the embodiment, the message "Accepted" is continuously displayed on the LCD 14*a* until the user inputs the STOP/EXIT key 14*e* through the operation panel section 14, However, after the message "Accepted" is displayed only for a predetermined time (for example, two seconds), the process may return to S603 for enabling the user to continue the setting change processing. In this case, the process may return to S601 if the user inputs the STOP/EXIT key 14*e* regardless of whether or not the user inputs the SET key 14*c*.

On the other hand, when the user inputs any key through the operation panel section 14 (YES at S601), if the input key is not the MENU key 14*c* (No at S602), whether or not the current MFD 1 mode is the COPY mode is determined (S610). If the current MFD 1 mode is the COPY mode (YES at S610), whether or not the input key is the START key 14*f* is determined (S611). If the input key is the START key 14*f* (YES at S611), the current copy setting is displayed on the LCD 14*a* only for a predetermined time (for example, two seconds) (S612) and then copy processing is executed (S613). The copy processing is generally well known processing and therefore will not be discussed in detail. Upon completion of the copy processing, the copy mode setting is restored to the default setting (S614) and then the process returns to S601. On the other hand, if the input key is not the START key 14*f* (NO at S611), whether or not the input key is a SETTING CHANGE key 14*j* is determined (S615). If the input key is the SETTING CHANGE key 14*j* (YES at S615), first the display on the LCD 14*a* is changed to display for enabling the user to change setting (S616) to facilitate setting change entry of the user. Whether or not the user inputs the ARROW key 14*d* or the numeric keypad 14*b* is determined (S617). If the user inputs the ARROW key 14*d* or the numeric keypad 14*b* (YES at S617), the display on the LCD 14*a* is changed based on the input key (S618). Next, whether or not the user inputs the SET key 14*c* is determined (S619). If the user inputs the SET key 14*c* (YES at S619), a message of "SET TEMPORARILY" is displayed on the LCD 14*a* only for a predetermined time (for example, two seconds) (S620) and the process returns to S601. The message is displayed for notifying the user that the change setting of the user in the COPY mode is temporary rather than permanent on the other hand, if the user does not input the SET key 14*c* (NO at S619), whether or not the user inputs the STOP/EXIT key 14*e* is determined (S621). If the user inputs the STOP/EXIT key 14*e* (YES ant S621), the setting change in the COPY mode is canceled. Then, the setting in the COPY mode is restored to the default setting (S614) before the process returns to S601.

On the other hand, if the user does not input the STOP/EXIT key 14*e* (NO at S623), the process returns to S617. Further, if the user does not input the ARROW key 14*d* or the numeric keypad 14*b* (NO at S617), whether or not the user inputs the SET key 14*c* is determined (S623). If the user inputs the SET key 14*c* (YES at S623), the process goes to S620. If the user does not input the SET key 14*c* (NO at S623), whether or not the user inputs the STOP/EXIT key 14*e* is determined (S624). If the user inputs the STOP/EXIT key 14*e* (YES at S624), the setting change in the COPY mode is canceled like the affirmative determination at S621 and thus the process goes to S614. However, if the user does not input the STOP/EXIT key 14*e*, namely, if the user inputs any other key than the ARROW key 14*d*, the numeric keypad 14*b*, the SET key 14*c*, or the STOP/EXIT key 14*e* through the operation panel section 14 (NO at S624) after the display on the LCD 14*a* is changed to display for enabling the user to change setting (S616), the user inputs an ineffective key through the operation panel section 14 and thus a beep is sounded (s625) and then the process returns to S617.

On the other hand, if the input key is not the SETTING CHANGE key 14*j*, namely, if the user inputs any other key than the MENU key 14*c*, the START key 14*f*, or the SETTING CHANGE key 14*j* (NO at S615) when the COPY mode is set in the MFD 1, processing responsive to the input key is executed (S622) and then the process returns to S601. For example, processing of storing the number of copies as the user inputs the numeric keypad 14*b* to set the number of copies corresponds to the processing at S622.

On the other hand, if the current MFD 1 mode is not the COPY mode (NO at S610), whether or not the current MFD 1 mode is the FAX mode is determined (S630). If the current MFD 1 mode is the FAX mode (YES at S630), whether or not the input key is the START key 14*f* is determined (S631). If the input key is the START key 14*f* (YES at S631), the current FAX setting is displayed on the LCD 14*a* only for a predetermined time (for example, two seconds) (S632) and then FAX processing is executed (S633). The FAX processing is generally well known processing and therefore will not be discussed in detail.

Upon completion of the FAX processing, the FAX mode setting is restored to the default setting (5634) and then the process returns to S601.

On the other hand, if the input key is not the START key 14*f* (NO at S631), whether or not the input key is the SETTING CHANGE key 14*j* is determined (S635). If the input key is the SETTING CHANGE key 14*j* (YES at S635), first the display on the LCD 14*a* is changed to display for enabling the user to change setting (S636) to facilitate setting change entry of the user. Whether or not the user inputs the ARROW key 14*d* or the numeric keypad 14*b* is determined (S637). If the user inputs the ARROW key 14*d* or the numeric keypad 14*b* (YES at S637), the display on the LCD 14*a* is changed based on the input key (S638). Next, whether or not the user inputs the SET key 14*c* is determined (S639). If the user inputs the SET key 14*c* (YES at S639), a message of "SET TEMPORARILY" is displayed on the LCD 14*a* only for a predetermined time (for example, two seconds) (S640) and the process returns to S601. The message is displayed for notifying the user that the change setting of the user in the FAX mode is temporary rather than permanent on the other hand, if the user does not input the SET key 14*c* (NO at S639), whether or not the user inputs the STOP/EXIT key 14*a* is determined (S641). If the user inputs the STOP/EXIT key 14*e* (YES at S641), the setting change in the FAX mode is canceled. Then, the setting in the FAX mode is restored to the default setting (S634) before the process returns to S601.

On the other hand, if the user does not input the STOP/EXIT key 14*e* (No at S641), the process returns to S637.

If the user does not input the ARROW key 14*d* or the numeric keypad 14*b* (NO at S637), whether or not the user inputs the SET key 14*c* is determined (S643). If the user inputs the SET key 14*c* (YES at S643), the process goes to S640. If the user does not input the SET key 14*c* (NO at S643), whether or not the user inputs the STOP/EXIT key 14*e* is determined (S644). If the user inputs the STOP/EXIT key 14*e* (YES at S644), the setting change in the WAX mode is canceled like the affirmative determination at S641 and thus the process goes to S634. However, if the user does not input the STOP/EXIT key 14*e*, namely, if the user inputs any other key than the ARROW key 14*d*, the numeric keypad 14*b*, the SET key 14*c*, or the STOP/EXIT key 14*e* through the operation panel section 14 (No at S644) after the display on the LCD 14*a* is changed to display for enabling the user to change setting (S636), the user inputs an ineffective key through the operation panel section 14 and thus a beep is sounded (S645) and then the process returns to S637.

On the other hand, if the input key is not the SETTING CHANGE key 14*j*, namely, if the user inputs any other key than the MENU key 14*c*, the START key 14*f*, or the SETTING CHANGE key 14*j* (NO at S635) when the FAX mode is set in the MFD 1, processing responsive to the input key is executed (S642) and then the process returns to S601. For example, processing of storing the telephone number or selecting the called party as the user inputs the numeric keypad 14*b*, single button dialing, abbreviating dialing etc., to enter the telephone number corresponds to the processing at S642.

On the other hand, if the current MFD 1 mode is not the FAX mode (NO at S630), whether or not the current MFD 1 mode is the SCANNER mode is determined (S650). It the current MFD 1 mode is the SCANNER mode (YES at S650), whether or not the input key is the START key 14*f* is determined (S61). It the input key is the START key 14*f* (YES at S651), the current scanner setting is displayed on the LCD 14*a* only for a predetermined time (for example, two seconds) (S652) and then scanner processing is executed (S653). The scanner processing is generally well known processing and therefore will not be discussed in detail. Upon completion of the scanner processing, the SCANNER mode setting is restored to the default setting (S654) and then the process returns to S601. On the other hand, if the input key is not the START key 14*f* (NO at S651), whether or not the input key is the SETTING CHANGE key 14*j* is determined (S655). If the input key is the SETTING CHANGE key 14*j* (YES at S655), first the display on the LCD 14*a* is changed to display for enabling the user to change setting (S656) to facilitate setting change entry of the user. Whether or not the user inputs the ARROW key 14*d* or the numeric keypad 14*b* is determined (S657). If the user inputs the ARROW key 14*d* or the numeric keypad 14*b* (YES at S657), the display on the LCD 14*a* is changed based on the input key (S658). Next, whether or not the user inputs the SET key 14*c* is determined (S659). If the user inputs the SET key 14*c* (YES at S659), a message of "SET TEMPORARILY" is displayed on the LCD 14*a* only for a predetermined time (for example, two seconds) (S660) and the process returns to S601. The message is displayed for notifying the user that the change setting of the user in the SCANNER mode is temporary rather than permanent.

On the other hand, if the user does not input the SET key 14*c* (NO at S639), whether or not the user inputs the STOP/EXIT key 14*e* is determined (S661). If the user inputs the STOP/EXIT key 14*e* (YES at S663), the setting change in the SCANNER mode is canceled. Then, the setting in the SCANNER mode is restored to the default setting (S654) before the process returns to S601.

On the other hand, if the user does not input the STOP/EXIT key 14*e* (NO at S661), the process returns to s657. If the user does not input the ARROW key 14*d* or the numeric keypad 14*b* (NO at S657), whether or not the user inputs the SET key 14*c* is determined (S663). If the user inputs the SET key 14*c* (YES at S663), the process goes to S660. If the user does not input the SET key 14*c* (NO at S663), whether or not the user inputs the STOP/EXIT key 14*e* is determined (S664). If the user inputs the STOP/EXIT key 14*e* (YES at S664), the setting change in the SCANNER mode is canceled like the affirmative determination at S661 and thus the process goes to S654. However, if the user does not input the STOP/EXIT key 14*e*, namely, if the user inputs any other key than the ARROW key 14*d*, the numeric keypad 14*b*, the SET key 14*c*, or the STOP/EXIT key 14*e* through the operation panel section 14 (NO at S664) after the display on the LCD 14*a* is changed to display for enabling the user to change setting (S656), the user inputs an ineffective key through the operation panel section 14 and thus a beep is sounded (S665) and then the process returns to S657.

On the other hand, it the input key is not the SETTING CHANGE key 14*j*, namely, if the user inputs any other key than the MENU key 14*c*, the START key 14*f*, or the SETTING CHANGE key 14*j* (No at S655) when the SCANNER mode is set in the MFD 1, processing responsive to the input key is executed (S662) and then the process returns to S601. For example, processing of cleaning the record head 4 as the user inputs an INK key not denoted by a reference numeral corresponds to the processing at S662.

On the other hand, if the current MFD 1 mode is not the SCANNER mode (NO at S650), the current MFD 1 mode is set to any other mode than the COPY mode, the FAX mode, or the SCANNER mode. Thus, processing responsive to the mode is executed (S670) and then the process returns to S601.

As is clear from the description given above, to change setting after inputting the MENU key 14*c* in the standby state of the MFD 1, the message "Accepted" is displayed on the LCD 14*a* when the setting is changed. Thus, the user can be notified that the setting of the MFD 1 has been changed permanently. On the other hand, to change setting without inputting the MENU key 14*c* in the standby state of the MFD 1, the message "Set Temporarily" is displayed on the LCD 14*a* when the setting is changed. Thus, the user can be notified that the setting of the MFD 1 has been changed temporarily. Therefore, the user can easily understand whether the setting change made by the user is permanent or temporary.

OTHER EMBODIMENTS

The invention is not limited to the specific embodiment previously described with reference to the accompanying drawings. For example, the following embodiments are also contained in the technical scope of the invention. Further, in addition the embodiments described below, various changes and modifications may be made in the invention without departing from the spirit and scope thereof.

(1) In the embodiment described above, the ink colors whose near empty state in detected are displayed all at a time on the LCD 14*a* in the near empty notification processing (S400). However, as another embodiment, the display on the LCD 14*a* may be changed for execution as in the operation shown in a flowchart of FIG. 13.

In this case, a timer T in a CPU 91 is made up of a first timer T1 and a second timer T2 as shown on FIG. 5C. In near empty notification processing shown in FIG. 13, the time counts of the two timers T1 and T2 in the CPU 91 are cleared to 0 and subsequently the two timers T1 and T2 start to count the time (S410). The contents stored in FLAG1 storage area 93*a* to FLAG4 storage area 93*d* in RAM 93 are checked in order. First, the contents stored in the FLAG1 storage area 93*a* are checked (S420) If "1" is stored in the FLAG1 storage area 93*a* (YES at S420), a message of "K: NEAR EMPTY" is displayed on the LCD 14*a* (S421). That is, the message to the effect that the black ink is near empty is displayed on the LCD 14*a* for notifying the user of the fact. Whether or not the timer T1 has counted 60 seconds is determined (s422). If the timer T1 has not yet counted 60 seconds (NO at S422), whether or not the timer T2 has counted 3 seconds is determined (S423). If the timer T2 has not yet counted 3 seconds (NO at S423), the process returns to S421. On the other hand, if the timer T2 has counted 3 seconds (YES at S423), the time count of the timer T2 is cleared to 0 and subsequently the timer T2 starts to count the time (S424). To check the contents of the FLAG2 storage area 93*b*, the process goes to S430. If "1" is not stored in the FLAG1 storage area 93*a* (NO at S420), the process also goes to S430. On the other hand, if the timer T1 has counted 60 seconds (YES at S422), the display of near empty on the LCD 14*a* is stopped (S460) and the process may return to S500.

Next, to determine whether or not cyan ink is near empty, the contents stored in the FLAG2 storage area 93*b* are checked (S430). The operation at S431 to S434 is almost similar to that at S421 to S424 described above and therefore will not be discussed again.

To determine whether or not magenta ink is near empty, the contents stored in the FLAG3 storage area 93*c* are checked (S440). The operation at S441 to S444 is also almost similar to that at S421 to 8424 described above.

Further, to determine whether or not yellow ink is near empty, the contents stored in the FLAG4 storage area 93*d* are checked (S450). The operation at S451 to S454 is also almost similar to that at S421 to S424 described above.

Therefore, according to the embodiment, for the ink color whose near empty state is detected, the display on the LCD) 14*a* is repeatedly changed every first predetermined time (here, every 3 seconds) and when a second predetermined time (here, 60 seconds) has elapsed as a whole, the near empty display is stopped and is changed to display of information concerning the current function of the MFD 1 (S500 in FIG. 6).

(2) In the embodiment described above, when the power of the image record apparatus is turned on or when a record command is entered, the remaining amount of ink of a recording agent is detected and if an ink cartridge 19 entering a near empty state exists, a message to the effect that the ink cartridge 19 is near empty is displayed only for the predetermined time. However, when the user simply makes a request for near empty notification through the operation panel section 14, the near empty notification processing shown in FIG. 8 or FIG. 13 may be executed.

Figure 8:
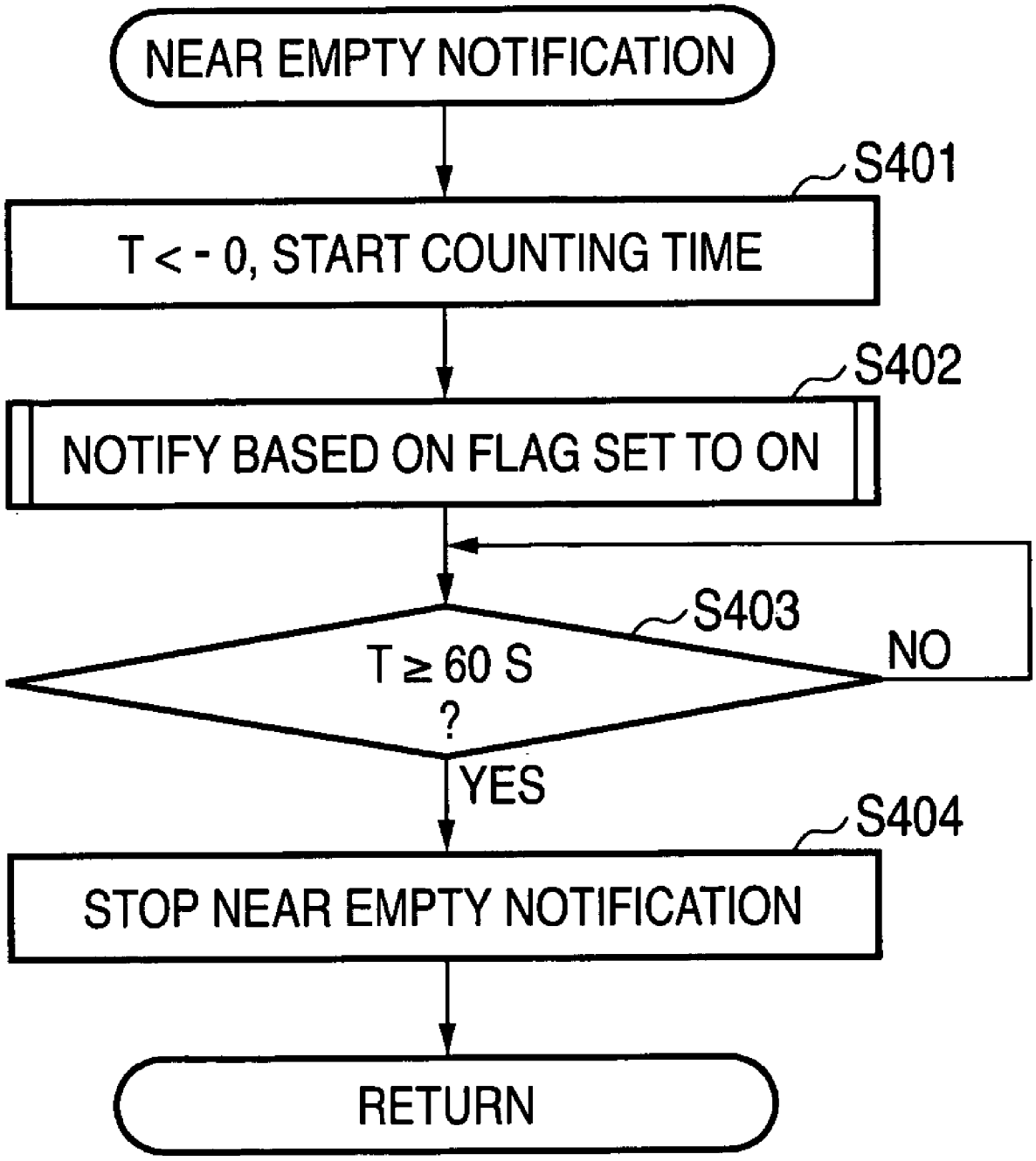
FIG. 8 is a flowchart to show near empty notification processing.
Figure 13:
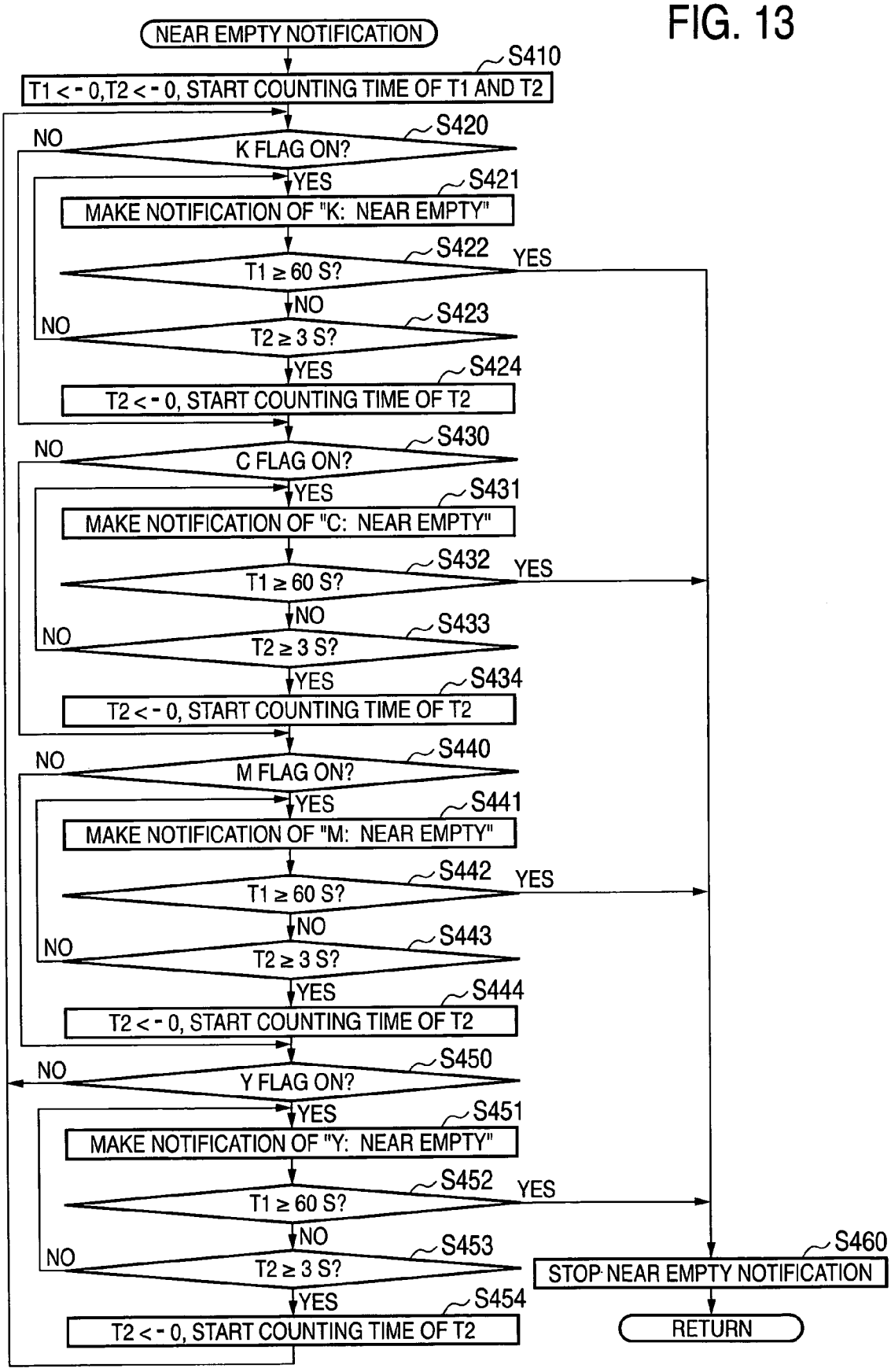
FIG. 13 is a flowchart to show near empty notification processing of another embodiment.
Figure 14:
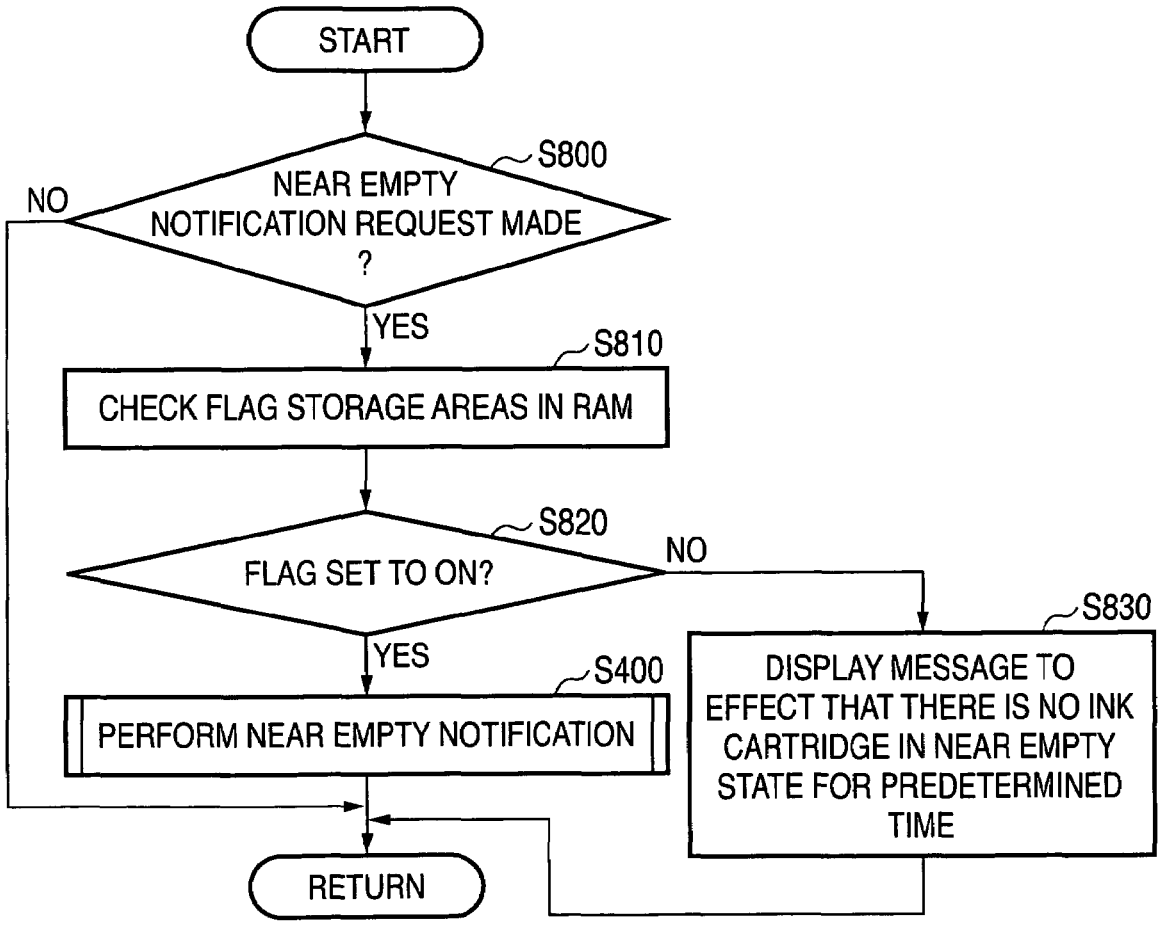
FIG. 14 is a flowchart to show processing performed when a near empty notification request is made in a standby state.

Specifically, as shown in FIG. 14, when the user enters a request for near empty notification by operating keys on the operation panel section 14 of the input member in the MFD 1 in the standby state (YES at S800), first the FLAG1 storage area 93*a* to the FLAG4 storage area 93*d* in the RAM 93 of the storage member are checked (S810). If a flag set to ON is detected, namely, if "1" is stored in any one of the FLAG1 storage area 93*a* to the FLAG4 storage area 93*d* (YES at S820), 5400 in FIG. 6, namely, the near empty notification processing shown in FIG. 8 or FIG. 13 is executed. On the other, if a flag set to ON is not detected, namely, if "1" is not stored in any of the FLAG1 storage area 93*a* to the FLAG4 storage area 93*d* (NO at S820), a message to the effect that there is no ink cartridge in near empty state is displayed only for a predetermined time (for example, 3 seconds) and the processing may be terminated. Therefore, in this case, the ink remaining amount detection operation with the ink remaining amount sensors 65 is not performed and the FLAG1 storage area 93*a* to the FLAG4 storage area 93*d* in the RAM 93 are only checked, so that near empty notification can be made rapidly in response to the demand of the user. However, for more precise operation, the ink remaining amount detection processing (S200) shown in FIGS. 6 and 7 may be executed between S800 and S810. When the user enters a request for near empty notification through the operation panel section 14, the processing as shown at S810 to S830 in FIG. 14 and S400 may be performed at the same time.

(3) In the embodiment described above, each ink remaining amount sensor 65 is implemented as the optical sensor made up of the light emission element 65*a* and the light reception element 65*b*, but any sensor may be used if it is a sensor capable of detecting the ink remaining amount.

(4) In the embodiment described above, the remaining amount of ink of a recording agent is detected in the ink-jet image record apparatus. However, similar advantages can also be provided in remaining amount detection of toner of a recording agent in a laser image record apparatus, remaining amount detection of an ink ribbon of a recording agent in a thermal transfer image record apparatus, etc., needless to say.

What is claimed is:

1. An image record apparatus capable of recording an image on a record medium using a recording agent, comprising:

a detection member that detects a remaining amount of a recording agent;

a notification member capable of notifying a user of the detection result of the detection member; and a control member that controls the detection member and the notification member, the control member controlling the detection member to detect the remaining amount of the recording agent at least when a first image record command is executed for the image record apparatus, wherein if the detection member detects that the remaining amount of the recording agent is equal to or less than a predetermined amount although image record on a record medium can be continued, the control member controls the notification member to notify the user that the remaining amount of the recording agent is equal to or less than the predetermined amount for a predetermined time, wherein the control member controls the notification member to stop the notification, and wherein the control member then provides the user with information concerning a current function of the image record apparatus, and the control member controls the detection member to detect the remaining amount again when a second image record command is executed after the first image record command.

2. The image record apparatus according to claim 1, wherein when power of the image record apparatus is turned on, the control member causes the detection member to detect the remaining amount of the recording agent.

3. The image record apparatus according to claim 1, further comprising:

a storage member that stores the detection result of the detection member; and an input member enabling the user to enter a command of causing the notification member to make a notification as to whether or not the remaining amount of the recording agent is equal to or less than the predetermined amount although image record on the record medium can be continued, wherein when the user enters the command through the input member, the control member causes the notification member to notify the user of the detection result stored in the storage member.

4. The image record apparatus according to claim 3, wherein when the user enters the command through the input member, the control member does not allow the detection member to operate.

5. The image record apparatus according to claim 1, wherein the predetermined time is 60 seconds.

6. An image recording apparatus configured to record an image on a recording medium using a recording agent comprising:

a detection member that detects a remaining amount of a recording agent;

a notification member configured to notify a user of the detection result of the detection member; and a control member that controls the detection member and the notification member, the control member controlling the detection member to detect a remaining amount of the recording agent at least when a first image record command is executed by the image recording apparatus, wherein, if the detection member detects that the remaining amount of the recording agent is equal to or less than a predetermined amount although image recording on a recording medium can be continued, the control member controls the notification member to notify the user for a predetermined time that the remaining amount of the recording agent is equal to or less than the predetermined amount, wherein the control member controls the notification member to stop the notification, and wherein the control member then provides the user with information concerning a current function of the image recording apparatus.

7. The image recording apparatus according to claim 6, wherein the control member controls the detection member to detect the remaining amount again when a second image record command is executed after the first image record command.

8. The image recording apparatus according to claim 7, wherein, when power of the image recording apparatus is turned on, the control member causes the detection member to detect the remaining amount of the recording agent.

9. The image recording apparatus according to claim 6, further comprising:

a storage member that stores the detection result of the detection member; and an input member enabling the user to enter a command of causing the notification member to make a notification as to whether or not the remaining amount of the recording agent is equal to or less than the predetermined amount although image recording on the recording medium can be continued, wherein, when the user enters the command through the input member, the control member causes the notification member to notify the user of the detection result stored in the storage member.

10. The image recording apparatus according to claim 9, wherein when the user enters the command through the input member, the control member does not allow the detection member to operate.

11. The image recording apparatus according to claim 6, wherein the predetermined time is 60 seconds.

* * * * *

UNITED STATES PATENT AND TRADEMARK OFFICE

CERTIFICATE OF CORRECTION

PATENT NO. : 7,284,808 B2
APPLICATION NO. : 11/071319
DATED : October 23, 2007
INVENTOR(S) : Daisuke Kasamatsu It is certified that error appears in the above-identified patent and that said Letters Patent is hereby corrected as shown below:

Title page, item [56] col. 2, in the References Cited under U.S. Patent Documents:
Please replace "2004/0041858" with --2004/0041856--.

Signed and Sealed this

Twenty-eighth Day of October, 2008

JON W. DUDAS
*Director of the United States Patent and Trademark Office*